US007945069B2

(12) United States Patent
Mango, III et al.

(10) Patent No.: US 7,945,069 B2
(45) Date of Patent: May 17, 2011

(54) LOUDSPEAKER PLASTIC CONE BODY

(75) Inventors: Louis A. Mango, III, Trafalgar, IN (US); John F. Steere, Martinsville, IN (US); Steven W. Hutt, Bloomington, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 1491 days.

(21) Appl. No.: 11/286,872

(22) Filed: Nov. 22, 2005

(65) Prior Publication Data

US 2006/0147081 A1 Jul. 6, 2006

Related U.S. Application Data

(60) Provisional application No. 60/629,907, filed on Nov. 22, 2004.

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 25/00* | (2006.01) |
| *H04R 7/00* | (2006.01) |
| *G10K 13/00* | (2006.01) |

(52) U.S. Cl. ..... 381/423; 381/150; 381/398; 181/167

(58) Field of Classification Search ..... 381/423, 381/150, 398; 181/167–170, 173

See application file for complete search history.

(56) References Cited

U.S. PATENT DOCUMENTS

| | | | | |
|---|---|---|---|---|
| 4,020,299 | A * | 4/1977 | Garner et al. | 381/432 |
| 4,190,746 | A * | 2/1980 | Harwood et al. | 381/427 |
| 4,239,943 | A | 12/1980 | Czerwinski | |
| 4,239,944 | A | 12/1980 | Obara et al. | |
| 4,412,103 | A | 10/1983 | Fujii et al. | |
| 4,737,992 | A | 4/1988 | Latham-Brown et al. | |
| 4,830,591 | A | 5/1989 | Eiermann et al. | |
| 5,149,486 | A | 9/1992 | Baba | |
| 5,521,886 | A | 5/1996 | Hirosawa et al. | 367/174 |

(Continued)

FOREIGN PATENT DOCUMENTS

| | | |
|---|---|---|
| EP | 0 632 674 A1 | 1/1995 |

(Continued)

OTHER PUBLICATIONS

Korean Office Action mailed Nov. 27, 2008, Korean Patent Application No. 10-2007-701157, 7 pgs. (English Translation 5 pgs.).

(Continued)

*Primary Examiner* — Curtis Kuntz
*Assistant Examiner* — Matthew Eason
(74) *Attorney, Agent, or Firm* — Brinks Hofer Gilson & Lione

(57) ABSTRACT

A loudspeaker cone body made of plastic includes a base carrier material and a filler material. The base carrier material is selected to optimize overall flow, weight and stiffness. The filler material may be a nanomaterial that provides for adjustment of process and acoustic related characteristics in the loudspeaker cone body that become relevant when the loudspeaker cone body is operated in a loudspeaker. Acoustic related characteristics that may be adjusted include a stiffness to weight ratio and an acoustic damping of the loudspeaker cone body. A predetermined weight percent of the filler material may be combined with the base carrier material to obtain repeatable desired acoustic related characteristics. The acoustic related characteristics may be adjusted by changing the predetermined weight percent of the filler material.

20 Claims, 14 Drawing Sheets

U.S. PATENT DOCUMENTS

| | | | | |
|---|---|---|---|---|
| 5,717,000 | A | 2/1998 | Karande et al. | |
| 5,837,763 | A | 11/1998 | Ferraro et al. | |
| 5,844,032 | A | 12/1998 | Serrano et al. | |
| 5,848,174 | A | 12/1998 | Ki et al. | |
| 5,998,528 | A | 12/1999 | Tsipursky et al. | |
| 6,039,145 | A | 3/2000 | Ogura et al. | |
| 6,050,509 | A | 4/2000 | Clarey et al. | |
| 6,090,734 | A | 7/2000 | Tsipursky et al. | |
| 6,224,801 | B1 | 5/2001 | Mango, III | 264/154 |
| 6,225,394 | B1 | 5/2001 | Lan et al. | |
| 6,232,388 | B1 | 5/2001 | Lan et al. | |
| 6,251,980 | B1 | 6/2001 | Lan et al. | |
| 6,269,167 | B1 | 7/2001 | Mango, III et al. | |
| 6,351,544 | B1 | 2/2002 | Noll | |
| 6,376,591 | B1 | 4/2002 | Lan et al. | |
| 6,407,155 | B1 | 6/2002 | Qian et al. | |
| 6,449,375 | B1 | 9/2002 | Hutt | |
| 6,462,167 | B1 | 10/2002 | Nodera et al. | 528/196 |
| 6,478,109 | B1 | 11/2002 | Kam | |
| 6,567,528 | B1 | 5/2003 | Heed | |
| 6,632,868 | B2 | 10/2003 | Qian et al. | |
| 6,700,988 | B2 | 3/2004 | Wu | |
| 7,763,675 | B2 | 7/2010 | Jarus et al. | 524/445 |
| 2001/0033924 | A1 | 10/2001 | Qian et al. | |
| 2002/0034315 | A1 | 3/2002 | Auerbach et al. | |
| 2002/0037954 | A1 | 3/2002 | Ohkawa et al. | |
| 2002/0137832 | A1 | 9/2002 | Ogoe et al. | |
| 2002/0156171 | A1 | 10/2002 | Drewniak et al. | |
| 2004/0001603 | A1 | 1/2004 | Sahyoun | |
| 2004/0022406 | A1 | 2/2004 | Hutt et al. | |
| 2004/0030021 | A1 | 2/2004 | Mitsunaga et al. | |
| 2006/0276579 | A1 | 12/2006 | Jarus et al. | |
| 2007/0185248 | A1 | 8/2007 | Qian et al. | 524/127 |
| 2008/0188587 | A1 | 8/2008 | Avakian | 523/122 |
| 2009/0074228 | A1 | 3/2009 | Mango, III et al. | 381/432 |

FOREIGN PATENT DOCUMENTS

| | | | | |
|---|---|---|---|---|
| EP | 1 090 744 | A2 | | 4/2001 |
| JP | 59-147598 | | | 8/1984 |
| JP | 04-172798 | | | 6/1992 |
| JP | 04-503739 | | | 7/1992 |
| JP | 06-225386 | | | 8/1994 |
| JP | 07-015793 | | | 1/1995 |
| JP | 07-203584 | | | 8/1995 |
| JP | 07-203584 | A | | 8/1995 |
| JP | 2000-159997 | | | 6/2000 |
| JP | 2000/224691 | | | 8/2000 |
| JP | 2003-049015 | | | 2/2003 |
| JP | 2003319488 | A | * | 7/2003 |
| JP | 2003-309895 | | | 10/2003 |
| JP | 2003-319490 | | | 11/2003 |
| JP | 2003 319490 | A | | 11/2003 |
| JP | 2004023509 | A | * | 1/2004 |
| WO | WO 90/03709 | | | 4/1990 |
| WO | WO 2004/041721 | A1 | | 5/2004 |
| WO | WO 2004041721 | A1 | * | 5/2004 |
| WO | WO 2004/065480 | A1 | | 8/2004 |
| WO | WO 2004/062833 | A1 | | 6/2006 |
| WO | WO 2006/062833 | A1 | | 6/2006 |
| WO | WO 2006/071833 | A1 | | 7/2006 |

OTHER PUBLICATIONS http://www.speakerbits.com/net/catalogs/cat20.aspx, Speakerbits, Speaker parts and repairs for dealers and consumers, spiders, Mar. 12, 2004.

http://editweb.iglou.com/eminence/eminence/pages/products02/oem/spiders.htm, Spiders, Mar. 12, 2004.

"Modern Plastics", mid-Nov. 1999, Polycarbonate, Resin & Compound, pp. A120-A121.

http://www.speakerbits.com/net/cataloqs/cat20.aspx, Speakerbits, Speaker parts and repairs for dealers and consumers, spiders, Mar. 12, 2004.

http://editweb.iglou.com/eminence/eminence/pages/products02/oem/spiders.htm, Spiders, Mar. 12, 2004.

"Modern Plastics", mid-Nov. 1999, Polycarbonate, Resin & Compound, pp. A120-A121.

Canadian Examination Report, mailed Dec. 3, 2009, Canadian Patent Application No. 2,586,928, 5 pgs.

Office Action dated May 31, 2010, from corresponding Japanese Patent Application No. 2007540434 (10 pgs) (w/ full translation).

Office Action issued Dec. 24, 2010, by the Japanese Patent Office in Japanese Patent Application No. 2007-540434, with English translation (9 pgs.).

Office Action issued Aug. 3, 2010 by the State Intellectual Property Office of the People's Republic of China in Chinese Patent Application No. 200580039987.7, with English translation (11 pgs.).

* cited by examiner

LOUDSPEAKER PLASTIC CONE BODY

PRIORITY CLAIM

This application claims the benefit of priority from U.S. Provisional Application No. 60/629,907, filed Nov. 22, 2004, which is incorporated by reference.

BACKGROUND OF THE INVENTION

1. Technical Field

This invention relates to loudspeakers, and more particularly, to a loudspeaker plastic cone body.

2. Related Art

A loudspeaker cone is a well-known part of every mid and low frequency loudspeaker. In addition, it is well known that a desirable loudspeaker cone body is one with sufficient amount of stiffness and minimized weight. This is known as stiffness to weight ratio. A specific modulus, Ys=Ye(Young's Modulus)/specific gravity, is defined as a figure of merit to compare and rank alternate materials and compositions.

Many of today's loudspeaker cone bodies are made of paper. Unfortunately, paper cone bodies may exhibit moisture problems. In addition, manufacturing tolerances of paper cone bodies are undesirably large.

Some cone bodies are made with polypropylene and may be made by injection molding. Although moisture and repeatability may be less of an issue with unfilled polypropylene, such cone bodies still exhibit a relatively low stiffness to weight ratio due to a relatively low modulus of un-reinforced polypropylene. Incorporating a filler reinforcement such as talc into the polypropylene improves its stiffness (flexural modulus) but reduces plastic flow during injection molding. Thus injection molding of larger cone bodies with thin wall sections is difficult. Further, such fillers increase material specific gravity so that the weight of a cone design increases as well. Therefore, to obtain sufficient stiffness characteristics, the weight of cone bodies may become undesirably high for optimal acoustic performance.

SUMMARY

The invention discloses a loudspeaker plastic cone body that is formed to include a base carrier material and a nanofiller. The nanofiller may be combined with the base carrier material in a predetermine weight percent to adjust a number of process and acoustically related characteristics of the loudspeaker cone body. Adjustment of the weight percentage of the nanofiller advantageously allows adjustment of acoustically related characteristics that affect stiffness to weight ratio and damping.

Due to the properties of both the base carrier material and the nanofiller, a compromise may be maintained between the otherwise conflicting goals of processability, low weight of the cone body, optimized stiffness and optimized acoustical damping. Processablity involves the improved flow characteristics to achieve improved manufacturablity of thin walled cones. Thus, as the weight percentage of the nanofiller in the base carrier material is increased, the stiffness may be increased and acoustical damping may be decreased without substantially increasing the weight of the cone body. The lack of a substantial increase in the weight of the cone body is due to the efficient additive properties of the nanofiller within the base carrier material. A relatively small weight percentage of nanofiller may provide a relatively large percentage change in stiffness, and damping at equivalent stiffness. Thus, a compromising balance may be achieved between the desire to optimize competing characteristics in the plastic cone body.

The nanofiller may include features that are nanoparticles or a gas that are dispersed in the base carrier material. The features are nanometer sized particles and/or nanometer sized structures that are distributed in the base carrier material. The resulting nanocomposite material may be formed into a cone body.

The cone body may be formed with a relatively thin sidewall using a molding process, such as injection molding. Thus, the tool used to mold the cone body part may include relatively close tolerances. The combination of the base carrier resin and the nanomaterial may advantageously possess sufficiently low viscosity (adequate shear rates) to fill such relatively close tolerances. The complimentary combination of the base carrier resin and the nanomaterial may provide sufficiently low viscosity over a range of weight percent of the nanomaterial without conflicting with the desired process and acoustical characteristics. Relatively high flow properties and relatively low specific gravity of the base carrier material may not be significantly compromised by the addition of the nanomaterial. In addition, shear thinning properties that may be included in the nanomaterials and the relatively small weight percentage of nanomaterial added to the base carrier material to achieve the desired process and acoustical results may have a favorable effect on the viscosity. Accordingly, satisfactory mold filling capability in thin walled sections may be maintained while still maintaining desirable stiffness to weight ratios and acoustical damping characteristics.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DESCRIPTION OF THE PREFERRED EMBODIMENTS

The present invention provides a loudspeaker cone made of plastic and plastic compatible materials which improves loudspeaker performance through improved stiffness to weight ratio and higher material damping at equivalent material stiffness. In addition, the loudspeaker cone manufacturing process described later may extend the range of practical cone geometries and cone sizes that may be produced. Specifically, the loudspeaker cone may be formed by injection molding and/or thermoforming from a predetermined mixture of materials that maximize the stiffness to weight ratio. In addition, the cone may have relatively thin wall sections. Since the cone bodies are made of plastic and other plastic compatible materials, raw materials may be more economical, manufacturing may be streamlined and repeatability may be improved. In addition, significant improvements in acoustical performance may be achieved.

The following examples employ certain combinations of material and process technology that may be used in concert to be beneficial for loudspeaker cone manufacturing, while yielding components with desirable acoustic performance. In loudspeaker cone manufacturing with plastics, two general areas that have significant bearing on acoustic performance are materials and processing. The degree or level of acoustic performance of a loudspeaker is related to the cooperative operation of a number of moving and non-moving parts associated with the loudspeaker.

Figure 1:
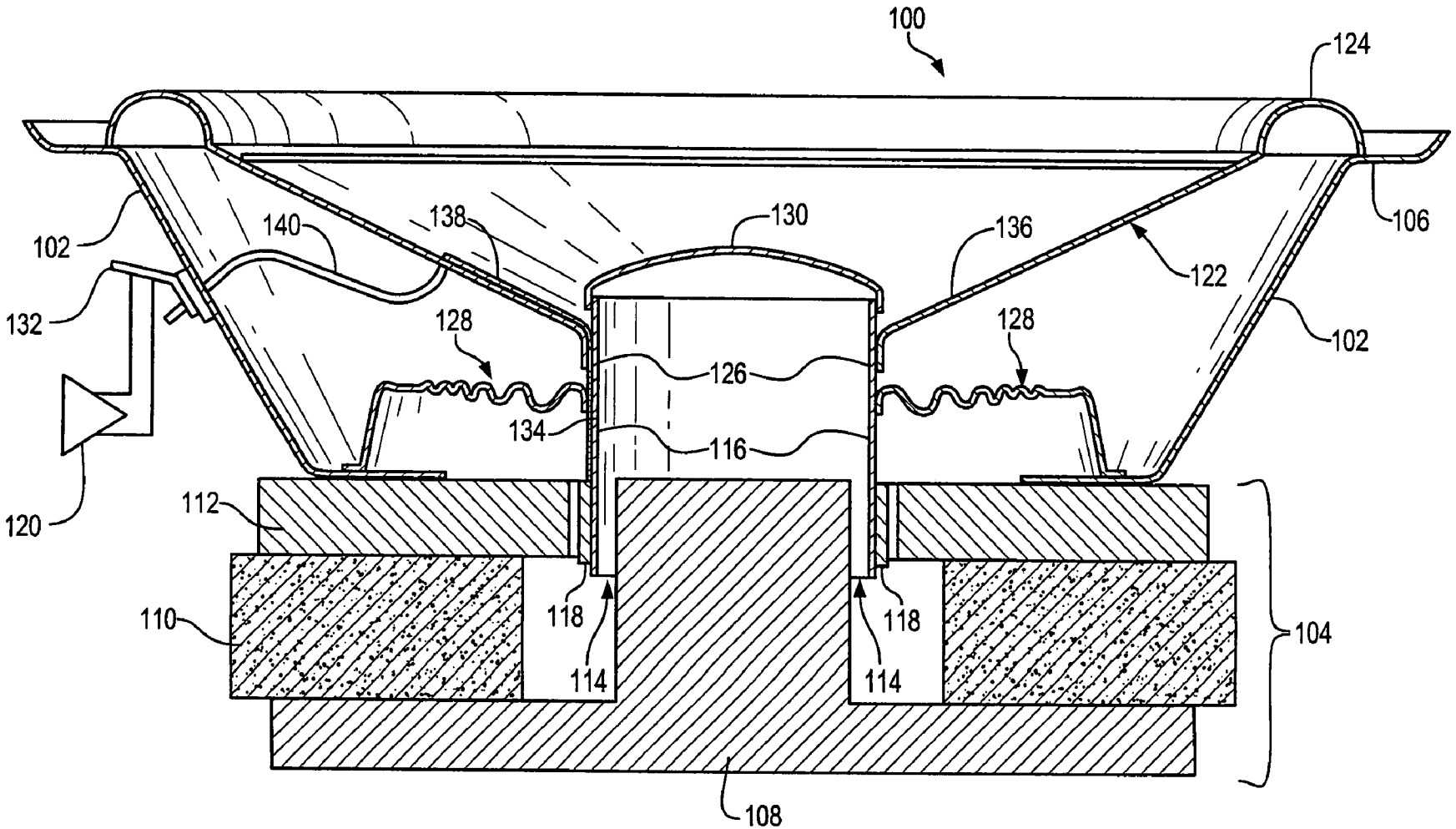
FIG. 1 is an example loudspeaker that may be mounted in a loudspeaker enclosure.

In FIG. 1, an example loudspeaker 100 is illustrated that may include a supporting frame 102 and a motor assembly 104. The frame 102 may include a lip 106 that extends outwardly from a main portion of the frame 102. The motor assembly 104 may include a back plate or center pole 108, a permanent magnet 110, and a front or top plate 112 that may provide a substantially uniform magnetic field across an air gap 114. A voice coil former 116 may support a voice coil 118 in the magnetic field. Generally speaking, during operation current from an amplifier 120 supplying electric signals representing program material to be transduced by the loudspeaker 100 drives the voice coil 118. The voice coil 118 may reciprocate causing it to reciprocate axially in the air gap 114. Reciprocation of the voice coil 118 in the air gap 114 generates sound representing the program material transduced by the loudspeaker 100.

The loudspeaker 100 may also include a cone 122. An apex of the cone 122 may be attached to an end of the voice coil former 116 lying outside the motor assembly 104. An outer end of the cone 122 may be coupled to a surround or compliance 124. The surround 124 may be attached at an outer perimeter to the frame 102. As set forth above, the frame 102 may also include the lip 106 that may be used to support mounting of the loudspeaker 100 in a desired location such as a surface or in a loudspeaker enclosure.

A spider 128 may be coupled at an outer perimeter of the spider 128 to the frame 102. The spider 128 may include a central opening 126 to which the voice coil former 116 is attached. A suspension including the surround 124 and the spider 128 may constrain the voice coil 118 to reciprocate axially in the air gap 114. In addition, the loudspeaker 100 may include a center cap or dust dome 130 that is designed to keep dust or other particulars out of the motor assembly 104.

The loudspeaker 100 may include a pair of loudspeaker terminals 132. The loudspeaker terminals 132 may provide a positive and negative terminal for the loudspeaker 100. A typical, although by no means the only, mechanism for completing the electrical connection between the loudspeaker terminals 132 and a pair of voice coil wires 134 is illustrated in FIG. 1. The voice coil wires 134 may be dressed against the side of the coil former 116, and pass through the central opening 126 and the intersection of the coil former 116 and the apex of the cone 122. In addition, the voice coil wires 134 may then be dressed across a face 136 of the cone 122 to a pair of connection points 138. At the pair of connection points 138, the voice coil wires 134 may be connected to a pair of flexible conductors 140. The flexible conductors 140 may be connected with the loudspeaker terminals 132. The pair of flexible conductors 140 may be made from tinsel, litz wire or any other suitable conductive material. The voice coil wires 134 may be fixed or attached to the face 136 of the cone 122 with an electrically non-conductive adhesive or any other suitable connection material.

The loudspeaker 100 set forth in FIG. 1 is illustrated with the frame 102, the cone 122, and the surround 124 formed in generally a circular shape. Different geometric loudspeaker shapes may also be used such as loudspeakers formed in the shape of squares, ovals, rectangles and so forth. In addition, the components that are used to form the loudspeaker 100 set forth above should be viewed in an illustrative sense and not as a limitation. Other components may be used to make the loudspeaker 100.

Figure 2:
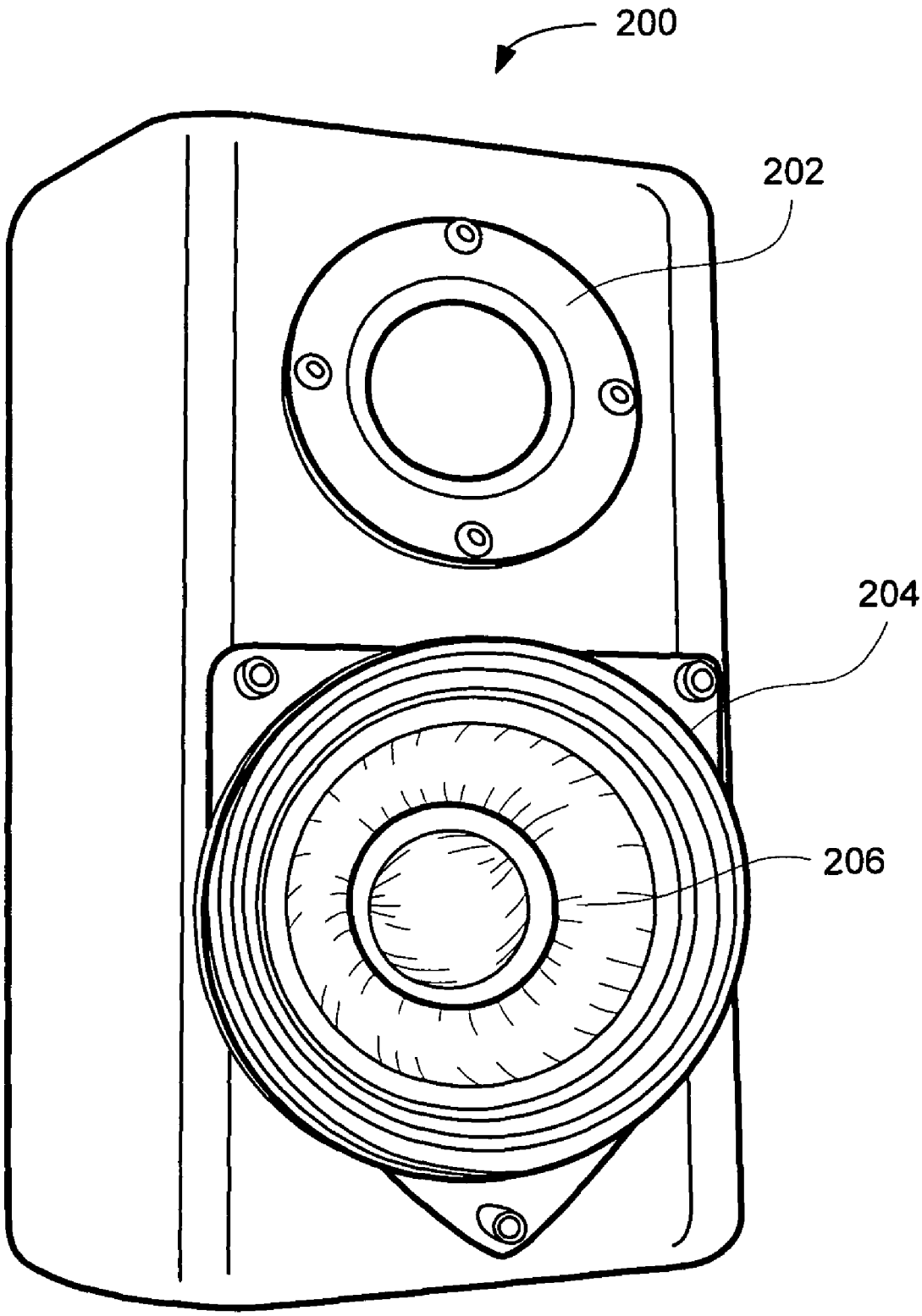
FIG. 2 is an example loudspeaker enclosure fitted with low frequency and high frequency loudspeakers.

FIG. 2 is an example loudspeaker enclosure 200 that includes a first loudspeaker 202 and a second loudspeaker 204. The first loudspeaker 202 is a tweeter, or high frequency driver operational in a high frequency range such as from about 5 kHz to about 25 kHz. The second loudspeaker 204 is a mid-range loudspeaker operational in a middle frequency range, such as about 100 kHz to about 6 kHz. The second loudspeaker 204 includes a cone body 206. In other examples, any other size and/or frequency range loudspeaker may be constructed to include a corresponding cone body 206.

In one example, the cone body 206 may be formed from a plastic such as polypropylene that includes a filler, such as nano-structured filler materials, also interchangeable referred to as "nanostructured materials", "nanofillers", and "nanomaterials" under proper conditions are defined herein as materials having at least one dimension in the nanometer-size. A nanometer (nm) is $10^{-9}$ meter, therefore, nanometer-size range encompasses from about 1 to 999 nm. The nano-structured filler materials may be natural, modified, or synthetic in nature, or any combination thereof. A base or carrier plastic, such as polypropylene that is extruded or otherwise combined with nano-structured filler materials is interchangeably referred to as a nanocomposite, a nano-filled composition, a nano-filled material, a nano-filled resin and nanocomposite compositions.

Improvement in the stiffness and damping qualities of a cone body while maintaining relatively low weight of the cone body may provide acoustic benefits to a loudspeaker operating with such a cone body. Improved damping may eliminate acoustic reflection and other undesirable vibration of the loudspeaker cone. Improved stiffness may provide extension of the pass band frequency range of the loudspeaker. Lower weight may enhance the response characteristics of the loudspeaker due to the lower mass being vibrated to produce sound. The stiffness, weight and damping characteristics may all provide enhanced performance of the loudspeaker, however, improvement in one or more of the characteristics (or parameters) can result in deterioration in the desirability of one or more other characteristics. Due to these conflicting goals, choices of materials, cone body design, and manufacturing processes can have significant bearing on acoustical performance. Selective combination of at least a predetermined weight percent of a base of carrier material and a predetermined weight percent of a nano-structured filler to form a nano composite has resulted in achievement of an optimal compromise in these conflicting goals.

Figure 3:
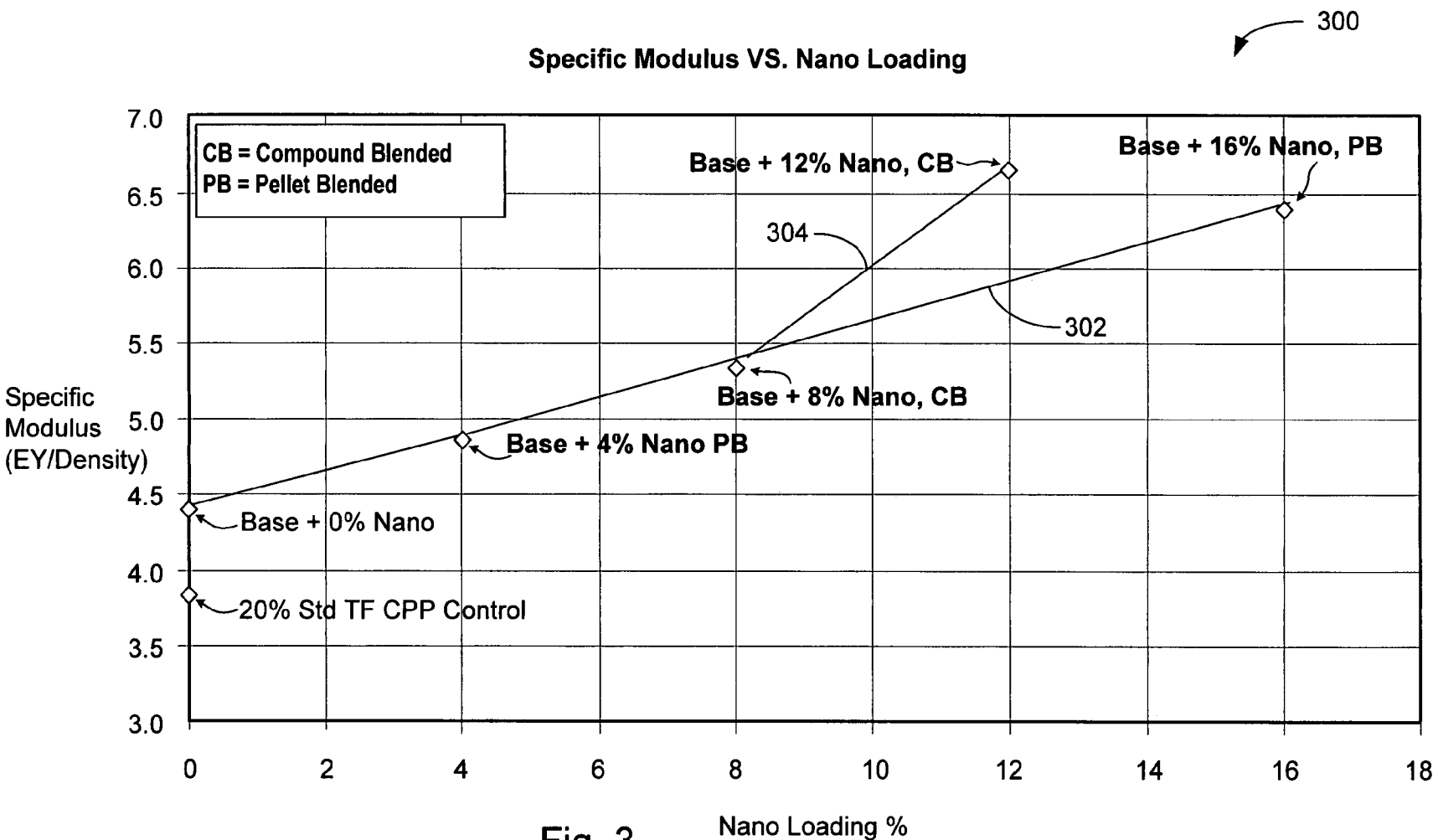
FIG. 3 is an example graph of specific modulus vs. nanomaterial loading for materials used to form a conebody.

The inclusion of a nano-structured filler in plastic may provide an improved stiffness to weight ratio and higher specific modulus when compared to a cone body made of only polypropylene or polypropylene with standard sized particle fillers such as talc, glass, calcium carbonate, wollastonite or others. FIG. 3 is an example graph 300 illustrating the increase in specific modulus, or stiffness of a conebody that includes a determined weight percent (wt. %) of nanomaterials blended into a carrier or. base material, such as polypropylene, by two different processes. In the illustrated example, the nanomaterials are a nanoclay and the carrier material is a high flow polypropylene that are described later. A first curve 302 is representative of an increasing specific modulus with increasing weight percent of nanomaterial in the form of a concentrate that is pellet blended with the carrier material as described later. A second curve 304 is representative of an increasing specific modulus with increasing weight percent of nanomaterials that may be compound blended with the carrier material absent a concentrate.

The specific modulus of a material may be defined as Ys=Ye/specific gravity and is a practical measure of weight efficiency. Ys is important to the design and function of speaker cones because the cone weight at the required stiffness directly affects speaker response and sound output. In FIG. 3, the first curve 302 illustrates that the selected carrier material without any weight percent of nanomaterials includes a specific modulus of about 3034 MPa. The first curve further illustrates an increase in the specific modulus from about 3034 MPa to about 4413 MPa as the weight percent of nanomaterials included in the cone body increases from about 0 to 16 percent. The second curve 304 illustrates an increase in specific modulus from about 5.3 to about 4619 MPa over a range of about 8 to 12 weight percent nanomaterials. In FIG. 3, relatively small increases in the weight percentage of the nanomaterials provide significant and desirable increases in stiffness. The weight percents and increases in specific modulus that are illustrated are only examples, and other increases in specific modulus with selected weight percents of nanomaterials are achievable. FIG. 3 also illustrates the specific modulus of a control material 306 that may be, for example, a 20 weight % talc filled polypropylene copolymer (CPP), to further illustrate the improvement in specific modulus with the addition of nanomaterials.

Mechanical damping is also a desirable property of cone body materials. Because very small fillers are far more efficient than conventional size fillers for developing material properties, polymer compositions with equivalent properties, such as stiffness may be made with lesser filler loadings. Such compositions of fillers may be referred to as "resin rich." Since overall damping (the ability to dissipate mechanical energy) is in part related to the volume fraction of resin that is present, such resin rich combinations may have improved damping and make desirable cone materials. The specific modulus and damping properties of nanomaterials intended for cone applications may be determined concurrently by dynamic mechanical analysis (DMA). Shear modulus data may be taken during a torsion test at a constant low strain (within the linear viscoelastic region) and constant frequency. A laboratory instrument such as the ARES rheometer described later is suitable for this task.

Figure 4:
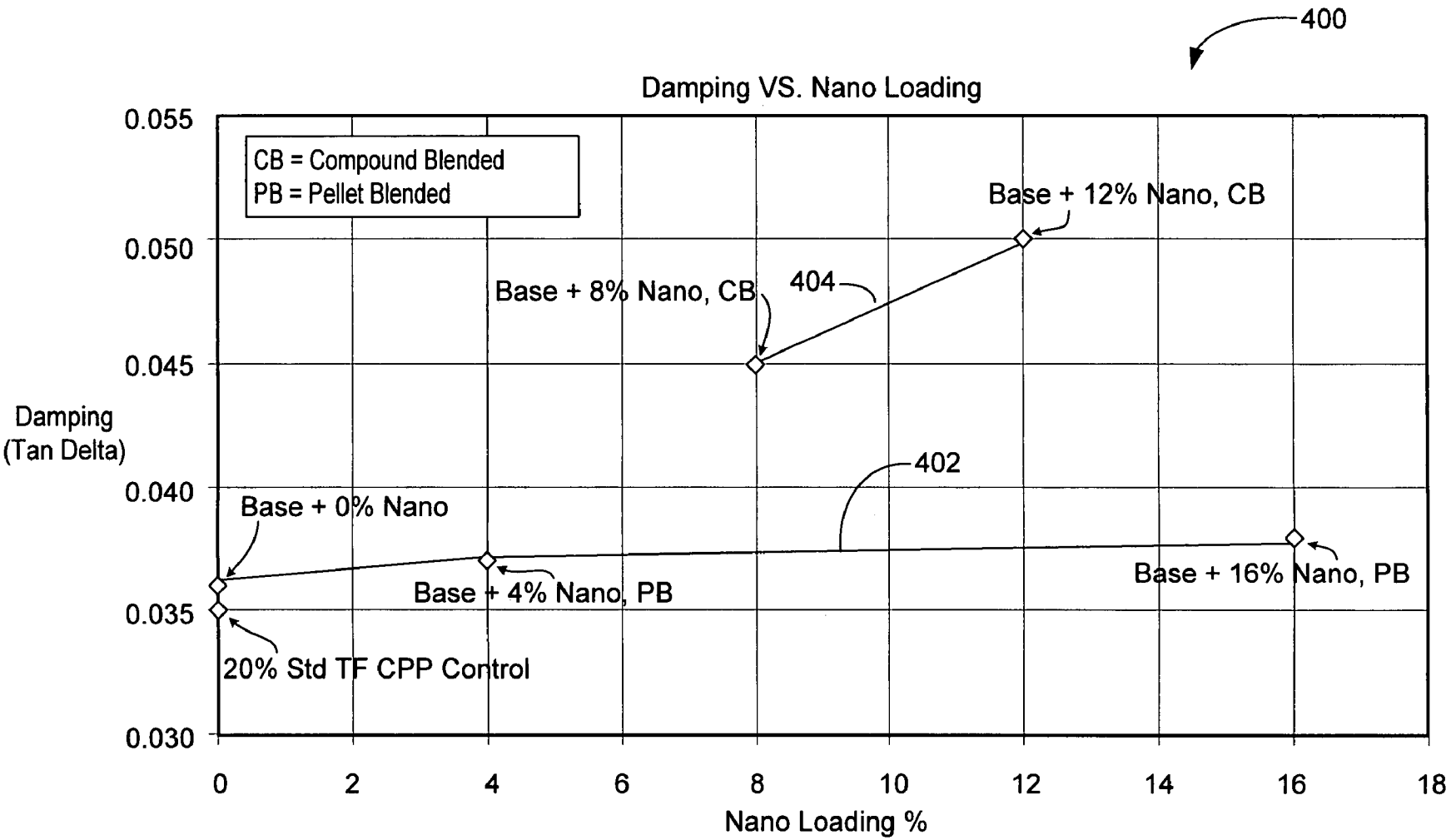
FIG. 4 is an example graph of damping vs. nanomaterial loading for the same materials used to form a conebody as in FIG. 3.

FIG. 4 is an example graph 400 illustrating damping vs. nanoloading for the same example cone body materials for which the specific modulus is represented in FIG. 3. In FIG. 4, a first curve 402 indicates a range of damping from about 0.036 tan delta to about 0.037 tan delta over the range of pellet blended nanomaterials from about 0 weight percent to about 16 weight percent. A second curve 404 indicates a range of damping from about 0.045 to about 0.050 over the range of the compound blended nanomaterials from about 8% to about 12%. Both of which included a higher resin content that resulted in improvements in damping over the control material 306. Thus, the addition of nanomaterials provides beneficial effects to both the stiffness and damping characteristics of a cone body.

Figure 5:
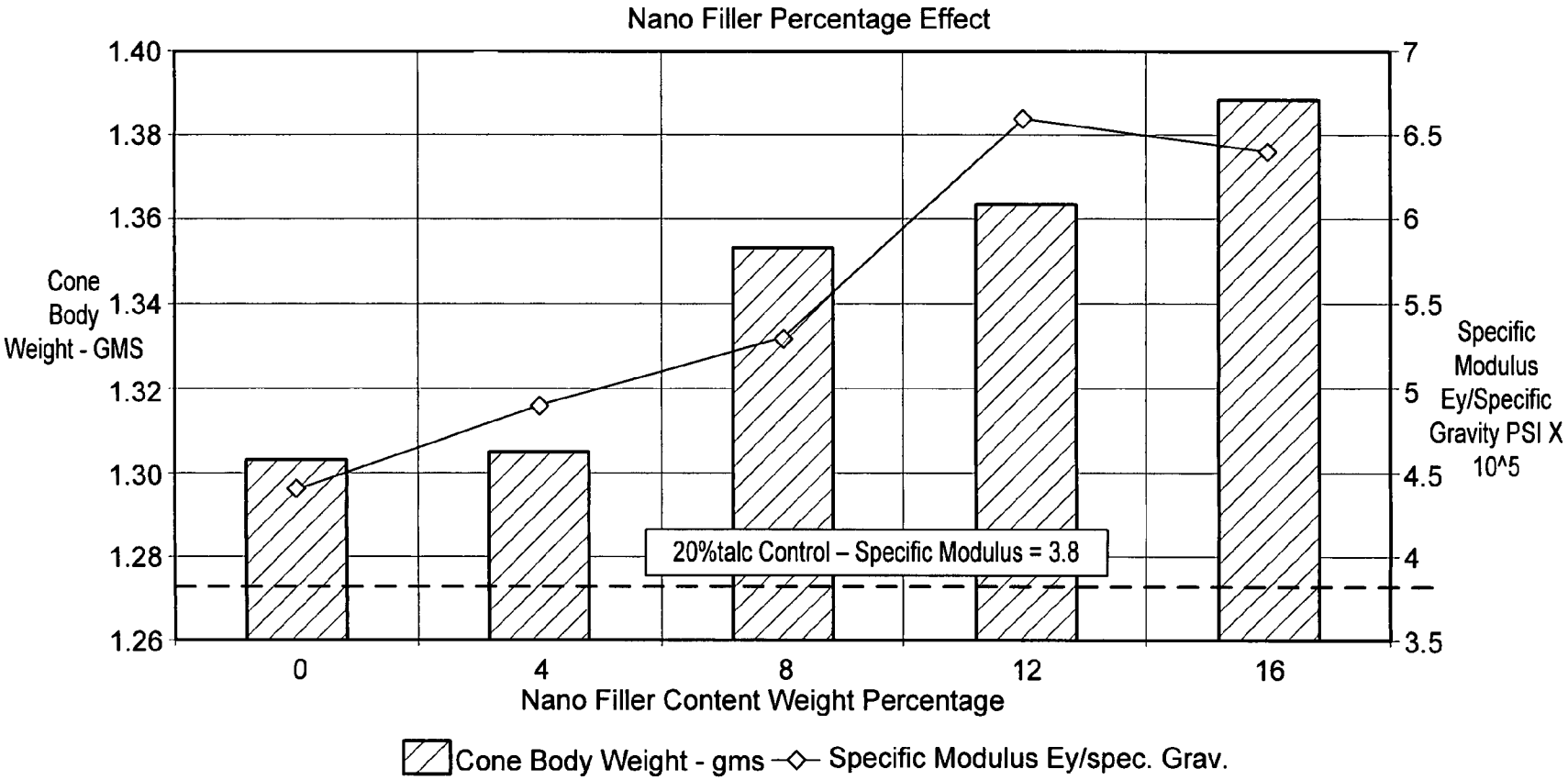
FIG. 5 is an example graph of weight vs. nanomaterial loading for the same materials used to form a conebody as in FIGS. 3 and 4.

Since both the specific gravity and damping of the cone body can be improved significantly with relatively small amounts of nanomaterials, the specific gravity of the nanocomposite (carrier and nanomaterials) remains substantially the same as the carrier by itself. FIG. 5 is an example graph 500 illustrating the difference in weight of the same cone body materials represented in FIGS. 3 and 4 as the weight percentage of nanomaterials increases. In FIG. 5, as the percentage of nanomaterials ranges from about 0 percent to about 16 percent, the overall weight of the cone body changes by approximately 6.5%. Accordingly, the inclusion of nanomaterials may relieve the otherwise conflicting goals in cone body manufacturing of achieving optimal acoustic performance with a relatively low stiffness to weight ratio and a relatively high damping factor.

Cone bodies may be manufactured by an injection molding process using a mold. The practical size and geometry of the cone component may be limited by the ability of a cone material to be processed readily in the thin wall sections of the mold. The limits and relative suitability for thin wall processing of a particular resin may be influenced by the viscosity characteristics of a particular filler and carrier resin combination, filler efficiency related to filler size, and the overall wt. % loading of any filler that may be present. In general, the lower the resin or resin-filler viscosity at a given shear rate the more facile the molding process will be, and the greater the process window will be for a given design challenge. Nano-filled materials may improve flow through both lower filler content requirements to achieve equivalent stiffness and greater shear thinning of the polymer melt during the injection molding process.

In filled compositions the filler may increase viscosity in direct proportion to a volume fraction of the filler according to polymer engineering theory. Through research and testing it has been determined that nano-fillers may be more efficient than conventional fillers on a weight basis in increasing a base material's specific modulus. A lesser weight % loading of nano-filler may be necessary to achieve a desired stiffness. Therefore, for a given carrier resin reinforced to an equivalent stiffness the increase in viscosity due to nano-filler loading will be less than that observed with standard size filler particles.

As will later be explained, the melt viscosity of nano-filled compositions may decline more rapidly with shear rate than conventionally filled materials in high shear environments like those present in injection molding. For at least these two reasons nano-filled materials may be effectively less viscous and more suitable for processing into thin wall cone body components.

Other nano-filler material additives and processes such as micro-cellular injection molding (MuCell) or Expancell may be used to facilitate cone molding and provide a higher specific modulus, and/or improve damping by other means. The MuCell process injects a nitrogen or carbon dioxide super critical fluid (SCF) into the base polymer while the melt is in the molding machine barrel, just prior to filling the mold cavity. Upon filling, the SCF spontaneously gasifies and a gas-solid dispersion is formed. The result is a light weight molding consisting of a gas dispersed in a solid polymer composition. In general, stiffness and weight may both be reduced, but the proportional changes favor a higher specific material modulus. Also, the entrained critical fluid may temporarily reduce the viscosity of the polymer melt allowing the polymer melt to flow more readily into a given mold cavity during injection, Alternately, Expancell is a material based technology wherein a polymeric additive with an entrained blowing agent is added to the plastic molding pellets and becomes dispersed in the polymer melt through the conveying, heating and mixing action of the molding machine screw. The entrained agent expands within the still discreet Expancel particles, which are constituted to retain their separate identity as the molten polymer composition is injected into the mold. Tiny "microballoons" are thus formed, which reduce the weight of the molded mass, and alter the damping properties of the molded mass. Both damping and specific modulus of the material may be increased.

High-Flow Composite Compositions

As used herein, the term "flow viscosity" refers to, the resistance of a polymer to flow when the polymer is in a fluid state. Shear viscosity is defined herein as the shear stress divided by the shear rate in steady shear flow. Viscosity can be given the units of Ns/m2 or Pa.s (these units are equivalent as 1 Ns/m2=1 Pa). Alternative units used for viscosity are poise where: 10 poise (g/cm s)=1 kg/m s=Ns/m2=1 Pa.s.

At least two methods are useful in identifying and defining "high flow" composite compositions for molding thin wall cone bodies—viscosity vs. shear rate determination, and melt index. The decline in material melt viscosity with shear rate is a characteristic flow property of polymer melts known as "thixotropy" or "shear thinning." Shear thinning is commonly exhibited by polymer melts and may be characterized with laboratory instruments designed to evaluate polymer rheilogy. One such instrument is the ARES Dynamic Mechanical Analyzer (DMA) a product of the TA Instruments Company of Delaware. In particular, a viscosity vs. shear rate test at constant temperature may be conducted to determine and compare the shear thinning behavior of thermoplastic materials.

In one example, a cone and plate or parallel plate test fixture geometry may be used, and may be operated in steady shear or dynamic shear modes depending on the shear range to be evaluated. Higher shear rates, at or above approximately 1 radian/second may be more readily evaluated in dynamic tests. The units for shear rate in this test mode are radians/second while the units of shear rate in steady shear are reported in reciprocal seconds, 1/sec. The data generated in either mode may be in proportion and may be inter-converted through use of the Cox-Mertz relationship. A test temperature representative of that used to injection mold the material into a component part of interest, such as a speaker cone, may be selected. Viscosity data may typically be gathered at (dynamic) shear rates from about 0.01 to approximately 1000 radians per second, however, data above about 10 rad/sec may be the most beneficial.

Figure 6:
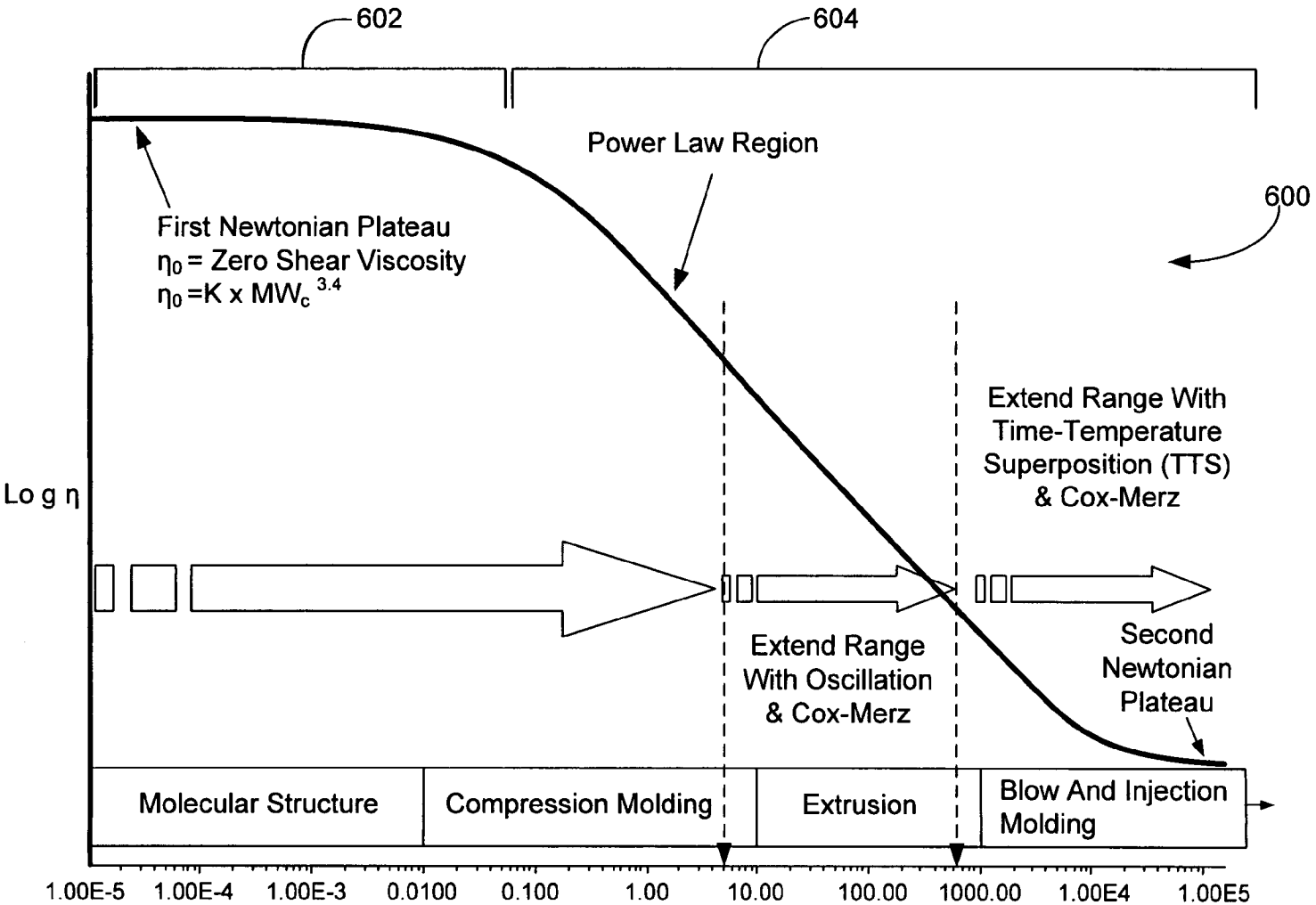
FIG. 6 is a rheology plot of shear rate and viscosity for an example material.

FIG. 6 is a log-log plot 600 of example viscosity data for an example plastic material. In FIG. 6, the illustrated curve may be divided into a first region 602 and a second region 604.

At low shear rates as identified with the first region 602, the viscosity curve is relatively flat indicating that viscosity is relatively independent of shear rate and the melt flow is said to be Newtonian. At higher shear rates as identified by the second region 604, above approximately 10 rad/sec, the viscosity drops rapidly in exponential proportion with increasing shear rate as thixotropy or shear thinning begins. Melt flow in this region is called "power law" flow behavior. The relative extent of shear thinning is then given by the slope of the log viscosity-log shear rate curve in this region. Power law flow can be representative of the behavior of polymer melts in the injection molding process where shear rates from a few hundred to several thousand rad/sec may occur.

As previously discussed, higher shear thinning compositions are preferred for thin wall injection molding of speaker cones. It follows that the preferred high-flow compositions may be identified and described by comparing the slope of the composition's viscosity shear rate curves determined at shear rates typical of injection modeling processes at constant temperature, for example, in the "power law" region in comparison to those of conventional compositions.

In particular, in FIG. 6, nano-composite compositions associated with increased specific modulus and damping also have greater shear thinning when compared to standard particle filled compositions such as talcs and clays. In addition, the onset of shear thinning behavior occurred at lower shear rates. Thus, a "cross-over" of the viscosity-shear rate curves of nano-filled compositions vs. standard filler compositions may be observed at higher shear rates. (see FIG. 7) Thin wall molding is thus improved so that, for example, the loudspeaker 204 can include a speaker cone comprising a well damped, high specific modulus, high-flow thermoplastic composite material.

The melt flow rate method is a measure of the ease of flow of a material, and may be used to determine how much material is extruded through a die in a given time when a load is applied to the molten sample in a barrel. The melt flow rate technique is described in ASTM test standard D1238 and is widely used for quality control and engineering specification purposes A high-flow composite composition preferably has a strength/weight ratio suitable for an intended application, and a viscosity at a high shear rate that is still low enough to permit injection molding of a cone body with a desired thickness. For example, high-flow composite compositions are desirably formulated to permit the manufacture of a speaker cone having a variety of thicknesses by injection molding. In particular, high-flow compositions permit the formation of thin-walled, as well as thicker-walled structures by injection molding. A thin-wall structure may have a thickness that is small compared to the injection flow path used to form the structure. Thin wall injection molding includes the injection molding of components with a relatively high flow length to wall thickness ratio, such as about 100:1 and higher. A thin-wall portion of a "mid-range" speaker cone can have a thickness of about 0.5 mm or less, preferably between about 0.1 mm and 0.5 mm, and more preferably between about 0.15 mm and 0.35 mm with a flow length in the approximate range of about 25 mm to 50 mm, where "about" refers to +/−5% of the nominal value.

High-flow composite compositions can be identified by measurement of the polymer melt viscosity at a temperature typical of that used for injection molding. For example, for nano filled polypropylene, the applicable temperature may typically be about 177 deg C. to about 232 deg C., and more likely between about 204 deg C. and about 218 deg C. Composite compositions having a relatively low viscosity at high shear rates are particularly preferred. In some examples of the composite material, a high flow polymer carrier, as described later, may desirably be selected to provide a more rapid reduction in viscosity as a function of shear rate, particularly for injection molding of thin wall structures.

The rheological properties of polypropylene compositions may be characterized by measuring the dynamic shear viscosity at shear rates within a range of about 0.1-1,000 radian/second and at about 210° deg C using a dynamic mechanical spectrometer. The viscosities at about 10 rad/sec and about 500 rad/sec are in the power law region and may be represented, respectively, as V10 and V500 with a ratio of the two referred to as VSRR (viscosity shear rate ratio)=V10/V100. It will be noted that the VSRR is the slope of the viscosity shear rate curve in the power law region, and is useful in defining and identifying high flow compositions that are desirable for thin-walled cone body molding processes. The higher the value the better the mold filling capability of the material. The high flow nano-composite polypropylene compositions for thin-walled nanocomposite cone bodies may have a VSRR above 3, more desirably above 6, and most desirably above 8, and the dynamic shear viscosity by DMA at 210 deg C. and 500 rad/sec is desirably less than about 5000 poise, and more desirably less than about 3000 poise.

Figure 7:
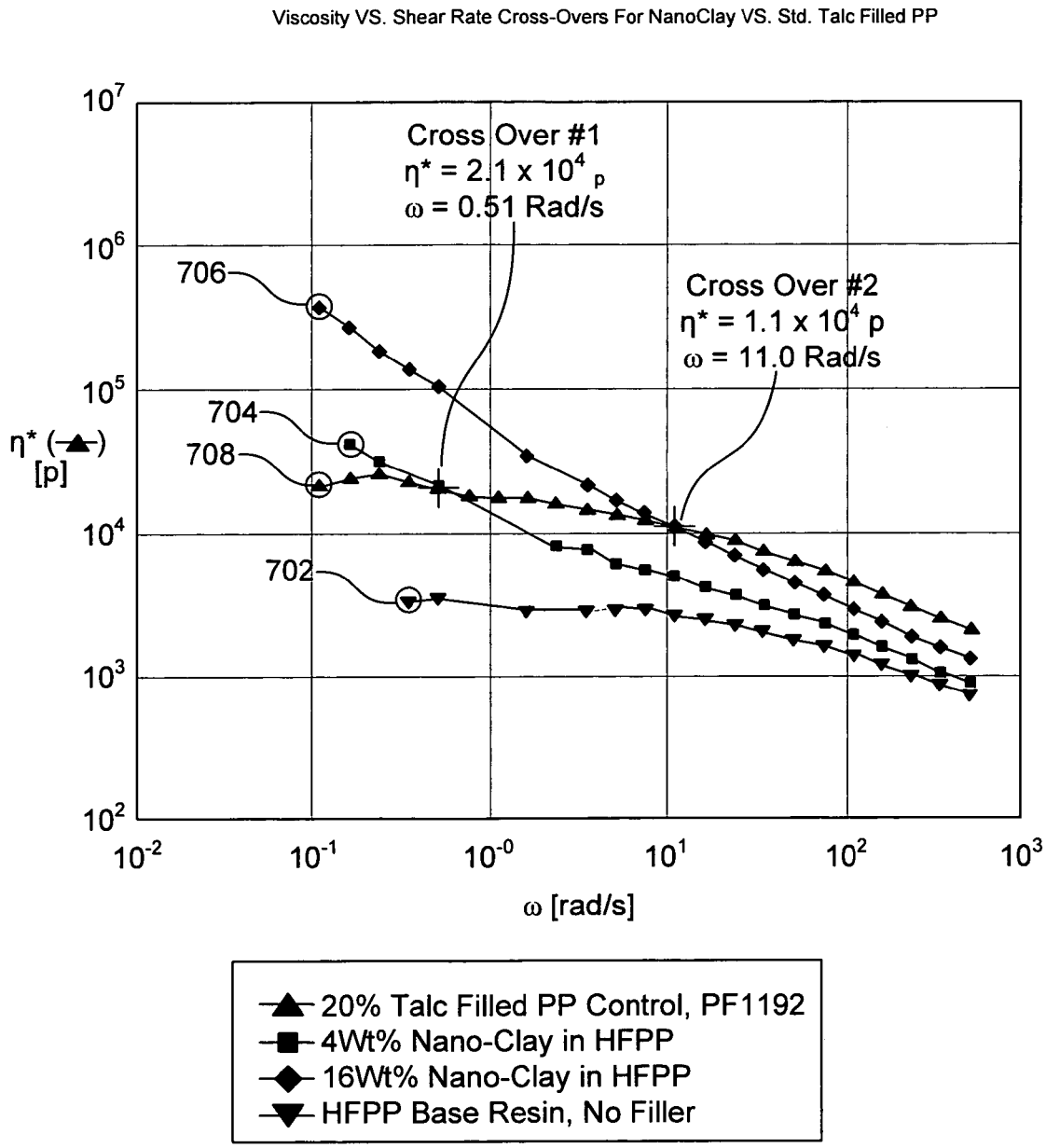
FIG. 7 is a rheology plot of shear rate vs. viscosity for an example polypropylene material and a plurality of example nanocomposite materials.

FIG. 7 is a graph 700 showing the viscosity-shear rate behavior of various example nano-filled compositions and polypropylene compositions that may be used to mold speaker cones. A first curve 702 is representative of an un-filled high flow base carrier, such as a high flow polypropylene. A second and third curve 704 and 706 represent a set of curves that were obtained from two nano-composites comprised respectively of approximately 4% and 16% by weight nanomaterials, such as aluminosilicate nano-filler in the high flow polypropylene carrier. A fourth curve 708 is a curve for a 20% talc reinforced polypropylene using a conventional size talc filler as a control.

The generally anticipated effect of filler loading on reducing flow is observed in the first, second and third curves 702, 704 and 706 for the nano-filled materials. However, key differences in flow behavior among the curves are apparent. Curves 704 and 706 for the nano-filled composites show the advantages of shear thinning behavior beginning at shear rates as low as about 0.1 radian/sec. Alternately, the viscosity of the fourth curve 708 (the standard talc composition) and the first curve 702 (the un-filled high flow carrier) did not appreciably decline until shear rates exceeded 10 radians/sec. Therefore, the advantages of shear thinning for more facile thin wall mold filling are onset sooner in the melt filling sequence when a nano-filler vs. a conventional filler is employed as the reinforcing agent. Secondly, enhanced shear thinning allows the melt viscosity of a high modulus, more highly loaded nano-composition such as that of the second and third curves 704 and 706 to "cross-over" the fourth 708 indicating the nano-filled material melts become effectively less viscous for injection molding of thin wall cones. For these examples the cross-overs may occur at about 1 rad/sec and at about 10 rad/sec, respectively.

High-Flow—High Modulus Carrier Materials

The high-flow composite composition of the example cone bodies includes a thermoplastic carrier and a filler to increase the stiffness/weight ratio and damping of the composition. The thermoplastic carrier is preferably a polymer that has a favorable combination of low density, high stiffness, stiffness retention at elevated temperature, and high flow as indicated by heat deflection behavior, and high melt flow rate. Broad and preferred ranges for these attributes may be defined for an un-filled resin state and may be set forth as follows: the specific gravity may be a broad range, such as less than about 0.95, and preferably may be less than about 0.92 (as measured by ASTM D792). The stiffness when expressed as a flexural modulus at about 23 deg C. per ASTM D790, may be a broad range greater than about 1,724 MPa, and preferably greater than about 2,068 MPa. Heat distortion temperature at 0.45 MPa, per ASTM D648, may be in a broad range of greater than about 107 deg C., and preferably 121 deg C. The melt flow rate per ASTM D1238, may be about 230 deg C., at about 2.16 Kg load, in a broad range that may be greater than about 12 gms/10 min, or in a narrower range greater than about 20 gm/10 min, or in an even narrower range greater than about 30 gm/10 min. Example carrier polymers include high-flow α-olefin polyolefins, such as a highly crystalline, nucleated polypropylene.

Suitable highly crystalline polypropylenes are available commercially in molding pellet form from BP Amoco Polymers, Inc. under the trade name ACCPRO. In some of the examples that follow, the carrier polymer is a high crystalline polypropylene ACCPRO 9934 (more recently re-named Innovene H35Z-02) from Amoco Polymers, Chicago, Ill. This polymer has a melt flow rate of about 35 grams/10 minutes, a specific gravity of 0.91, a flex modulus of about 2241 MPa, a heat deflection temperature of 135 deg C. at 66 pai, and a tensile strength of 41.5 MPa (ATM D638, 26.7 deg C.).

Figure 8:
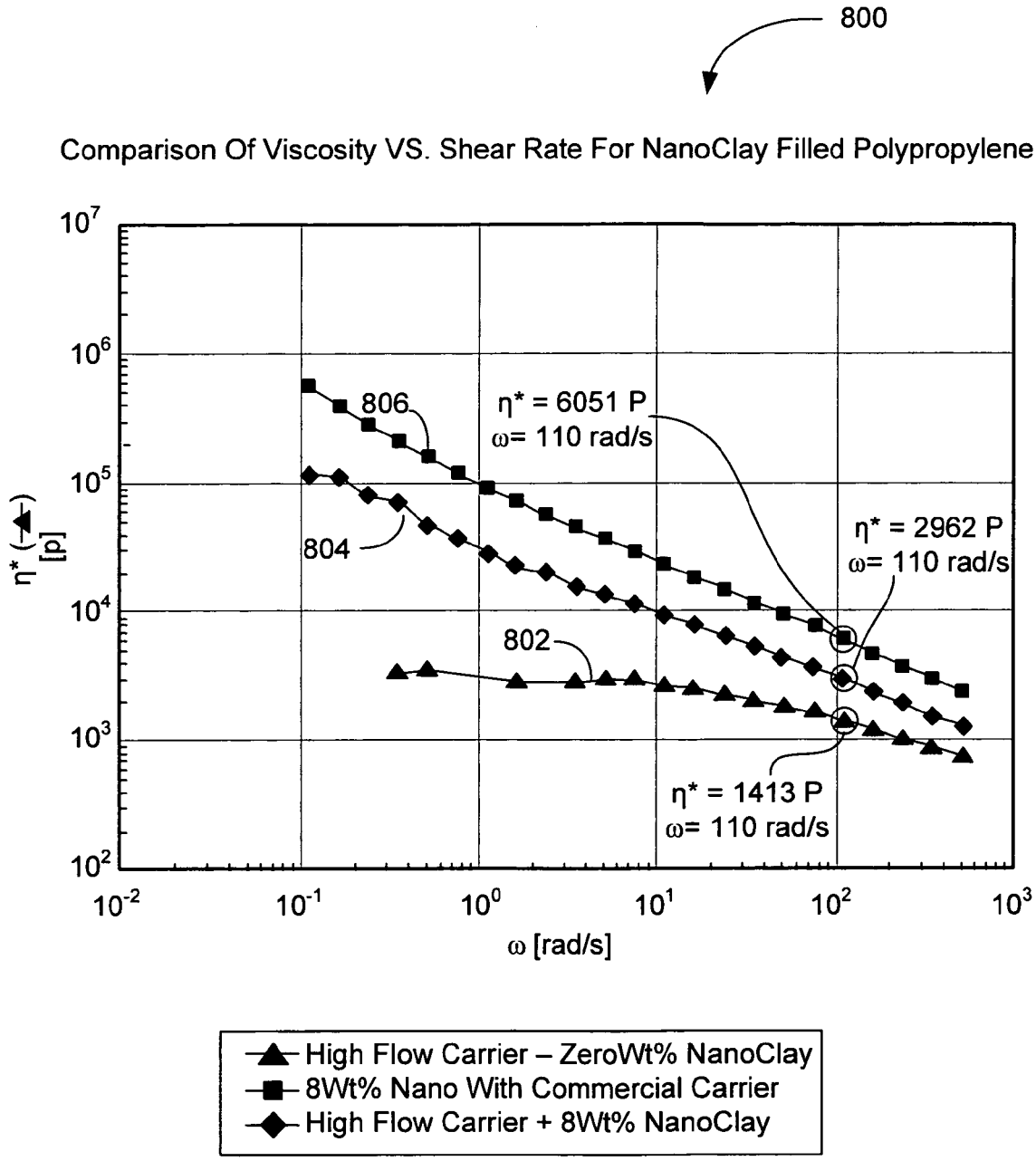
FIG. 8 is a rheology plot of shear rate vs. viscosity for a nanomaterial, a carrier material and a nanocomposite that includes the nanomaterial and the carrier material.

FIG. 8 is a set of example curves of viscosity vs. shear rate that illustrate the contribution of a high flow carrier to the ability of a high flow nano-composite composition to fill a thin section mold. A first curve 802 represents the flow behavior for the unfilled high flow carrier, and a second curve 804 represents the behavior for the carrier plus 8 wt % nano-filler. The shear thinning effect of the nano-filler, and a viscosity increase due to the addition of 8 wt % nano-filler to the high flow carrier is apparent. A third curve 806 is representative of another nano-filled polypropylene, also with 8 wt % nano-filler. The shear thinning effect—related to the filler—remains evident, but throughout the entirety, the third curve 806 is shifted to consistently higher viscosity values. Clearly, the choice of carrier resin is a significant factor for obtaining the overall high flow nano-filled compositions that are desirable to fill a mold designed to produce thin wall plastic cones.

Polypropylene carrier resins are initially produced in powder form. The resin powder may be blended with additional components and used directly in the production of molded and extruded goods, or may be first compounded and pelletized according to methods commonly employed in the resin compounding art. For example, dried resin may be dry blended with such stabilizing components, nucleating agents and additives as may be required, then fed to a single or twin screw extruder. The polymer, extruded through a strand die into water, may then be conveniently chopped to form pellets and stored for subsequent blending to provide the described blends for further fabrication.

Such un-filled materials may be extrusion compounded to directly incorporate the nano-filler at the desired level, or to produce a filler concentrate that can be mixed at the final injection molding stage with the same or other compatible base resin to accomplish the final desired nano-filler loading. Alternately, nano-filler concentrates where another compatible base resin has been used as the carrier may be mixed in proportion with a high flow resin, such as the high flow ACCPRO resin, to achieve compositions with the desired nano-filler content. Commercially available nanofiller concentrates and generic or custom molding grade nano-filled resins are made by PolyOne of Avon Lake, Ohio under the trade name Maxxim. One example of a commercial 40+/−2 wt % nano-filled concentrate is Maxxim MB1001, made for use with polypropylene.

Filler

Nano-structured filler materials can be introduced by direct compounding into a high flow carrier, or through a pellet concentrate blended with high-flow carrier pellets at the injection molding press. The high flow base resin and the carrier resin used to form the concentrate must be compatible but may or may not be identical to each other. Preferably, the eventual thermoplastic composite material will have from 4 wt % to about 20 wt %, and more preferably from 4 wt % to 12 wt % of the nano-structured filler.

Nanostructured materials particularly suitable for use include one or more of the following categories of nano-sized features: nanoparticles, multilayers (nanofilms), nanocrystalline and nanoporous material, nanocomposites, and nanofibers (nanotubes and nanowires), and any combination thereof. A nanostructured material might, for example, contain a single nanocrystalline material or it might contain two nanocomposites combined with a type of nanoparticle. Nanocrystalline materials, for example, are crystallites of about 1 to 10 nm in dimension where an ultrahigh surface-to-volume ratio can be readily achieved. Nanoporous materials, on the other hand, are characterized by the molecular assembly of structures consisting of nanometer-sized cavities or pores. Typical nanostructured materials may be composed of aluminosilicates, carbonaceous materials, layered double hydroxides, or mixtures thereof.

Preferred nanostructured materials may be composed of aluminosilicates, carbonaceous materials, layered double hydroxides, or mixtures thereof. Aluminosilicate nanostructured materials include, but are not limited to, polysilicates such as phyllosilicates such as the smectite group of clay minerals, tectosilicates such as zeolites, tetrasilicates such as kenyaite, and zeolites. Natural or synthetic phyllosilicates, for example, are sheet structures basically composed of silica tetrahedral layers and alumina octahedral layers. Phyllosilicates are a preferred type of structured nanomaterial, and a preferred type of phyllosilicate includes one or more smectite clays alone or in combination with other compatible structured nanomaterials. Additional examples of phyllosilicates useful in plastic cone bodies include, but are not limited to, montmorillonite, nontronite, beidellite, hectorite, saponite, sauconite, kaolinite, serpentine, illite, glauconite, sepiolite, vermiculite, or mixtures thereof. Though not restricted in particular, the total cation exchange capacity of the phyllosilicates can preferably be 10 to 300 milliequivalents, more preferably from 50 to 200 milliequivalents, per 100 grams of the phyllosilicate material. Phyllosilicate nanomaterials (i.e., nanoclays) are commercially available from Nanocor, Inc. of Arlington Heights, Ill. as NANOMER and from Southern Clay Products, Inc. of Gonzales, Tex. as CLOSITE.

Carbonaceous nanomaterials can also be used to form nanostructured composite materials. Examples of carnabaceous fillers include fullerenes, carbon nanoparticles, diamondoids, porous carbons, graphites, microporous hollow carbon fibers, single-walled nanotubes and multi-walled nanotubes. Fullerenes typically consist of 60 carbon atoms joined together to form a cage-like structure with 20 hexagonal and 12 pentagonal faces symmetrically arrayed. Preferred fullerene materials include C60 and C70, although other "higher fullerenes" such as C76, C78, C84, C92, and so forth, or a mixture of these materials, could conceivably be employed. Graphite is a crystalline form of carbon comprising atoms covalently or metallically bonded in flat layered planes with weaker van der Waals bonds between the planes.

Additional Composite Materials

The composite materials may also include a compatibilizing aid to promote and improve adhesion between the propylene polymer matrix and the cellulose fiber filler. As used herein, the term "compatibilizing aid" means any material which can be mixed with polypropylene and cellulose fiber to promote adhesion between the polypropylene matrix and the fiber. The compatibilizing aid preferably will comprise a functionalized polymer, which may be further described as a polymer compatible with the propylene polymer matrix and having polar or ionic moieties copolymerized therewith or attached thereto. Typically, these functionalized polymers are propylene polymers grafted with a polar or ionic moiety such as an unsaturated carboxylic acid or anhydride thereof, for example, (meth)acrylic acid, maleic acid, fumaric acid, citraconic acid, itaconic acid or the like.

The propylene polymer portion of the graft copolymer may be a homopolymer of propylene or a copolymer of propylene with another alpha-olefin such as ethylene; a homopolymer of propylene is preferred. Functionalized propylene polymers include maleated polypropylene with a maleation level of from about 0.4 to about 2 wt. %, preferably 0.5-1.25 wt. %, and a melt index (MI) of from about 1 to about 500 g/10 min., preferably from about 5 to about 300 g/10 min., determined at 190 degree. C. and 2.16 kg. A particularly suitable maleated polypropylene is available under the tradename Polybond.™. 3200 from Uniroyal. Other grades of Polybond.™. resins may be found suitable, as may Fusabond.™. maleated polypropylene resins from DuPont, Epolene.™. modifier resins from Eastman Chemicals, and Exxelor.™. modifier resins from Exxon Chemicals.

The functionalized polymer, when employed, may be incorporated into a cone body 206 in an amount sufficient to act as a compatibility agent between polymeric materials and the cellulosic fiber. Typically, about 0.3 to about 12 wt. % of functionalized polymer is sufficient to provide adequate adhesion between the polymer matrix and the fiber component. Since the functionalized polymer is more expensive than the bulk high crystalline propylene polymer, there is an economic incentive to minimize the proportion of such functionalized polymer in the total product. Preferably, such functionalized polymer is incorporated into the product of this invention at a level of about 0.5 to 10 wt. % and most preferably at a level of about 1 to 6 wt. %, based on total weight of resin and filler components. Products containing from about 1 to about 4 wt. % functionalized polymer, especially maleated polypropylene, were found to be especially suitable.

Injection Molding of High-flow Thermoplastic Composite Compositions

Speaker cones can be formed by formulating a thermoplastic composite and shaping the composite using thermoplastic molding techniques. The composite may be prepared by shear mixing a propylene-based polyolefin carrier material and the nano-structured material in the melt at a temperature equal to or greater than the melting point of the polymer. The temperature of the melt, residence time of the melt within the mixer and the mechanical design of the mixer are several variables which control the amount of shear to be applied to the composition during mixing.

Alternatively, the carrier may be granulated and dry-mixed with each nano-material, and thereafter, the composition heated in a mixer until the polymer is melted to form a flowable mixture. This flowable mixture can then be subjected to a shear in a mixer sufficient to form the desired composite. The polymer may also be heated in the mixer to form a flowable mixture prior to the addition of the nanostructured material and then subjected to a shear sufficient to form the desired ionomeric nanocomposite. The amount of the nanostructured material most advantageously incorporated into the polyolefin is dependent on a variety of factors including the specific nanomaterials and polymers used to form the composite, as well as its desired properties.

In one example, a composite material is prepared by mixing the components in a modular intermeshing co-rotating twin-screw extruder, such as those manufactured by Werner-Pfleider. Other manufacturers of this type of equipment include co-rotating twin screw extruders from Berstorff, Leistritz, Japanese Steel Works, and others. The screw diameter for this type of mixer may vary from about 25 mm to about 300 mm.

The mixing extruder includes a series of sections, or modules, that perform certain mixing functions on the composition. The polymeric components are fed into the initial feed section of the extruder as solid granules at the main feed hopper. Other ingredients, such as fillers, thermal stabilizers, and the like, may also be fed into the main feed hopper of the mixing extruder as dry powders or liquids. The majority of thermal stabilizers and UV stabilizers may be added in a downstream section of the mixer. Each optional ingredient can be admixed with the blend, admixed with the ingredients during manufacture of the blend. The above blends may be manufactured by, for example, extrusion. The polyolefin resin blends may be mixed by any conventional manner that insures the creation of a relatively homogeneous blend. Optional ingredients can also be prepared in the form of a masterbatch with one or more of the other primary or optional ingredients as previously described.

The components are typically homogenized with an initial melting and mixing section of the extruder. The polymer melt temperature is raised by a sequence of kneading blocks to just above the highest softening point of the polymer blend. A melt temperature of about 160° C. to 230° C. may be used for the first mixing section.

Subsequent to the first mixing section, there is a second mixing section of the extruder to perform kneading and distributive mixing. The mixing temperature in this section can be from about 160° C. to about 22° C., or can be from about 170° C. to about 220° C., in order to bring about sufficient dispersion of the nanostructured material in the polyolefin blend. The residence time within the second mixing section should be at least 10 seconds, but no more than 100 seconds to prevent excessive thermal degradation. Preferably, the nano-structured material is at least substantially uniformly dispersed within the polyolefin, and more preferably, it is uniformly dispersed within the polyolefin.

The final section of the mixing extruder uses melt compression prior to extrusion through a die plate. The melt compression can be accomplished with the co-rotating twin screw extruder, or melt compression can be done via a decoupled process, such as a single screw extruder or a melt gear pump. At the end of the compression section, the composition is discharged through a die plate.

The composite may be pelletized via strand pelleting or commercial underwater pelletization. Pellets of the composite composition may then be used to manufacture articles in the desired shape or configuration by any of a number of means, such as various types of injection molding procedures, extrusion or co-extrusion procedures, compression molding procedures, thermoforming procedures, or the like. The compositions may be formulated to have a melt flow appropriate for the conventional molding or forming equipment that is desirably used.

The performance of the cone body 206 formed to include a filler, such as nanomaterials, may provide a frequency response with low total harmonic distortion (THD) as described later. In addition, the mass of the plastic cone body 206 may be advantageously reduced. Since sensitivity is inversely proportional to mass, the reduced mass will increase sensitivity of the loudspeaker to audio signals. Plastic cone bodies may also be water-proof or at least water resistant. Depending upon the base resin selection, some nano-composite plastics may exhibit better flame resistance and higher service temperature capability than paper, which are sometimes important for cone applications.

Due to the raw materials used in manufacture being relatively uniform, the process variability of plastic cone bodies may be significantly reduced when compared to conventional paper cone bodies and/or metal cone bodies. In addition, the plastic cone bodies may be more robust when compared with paper cone bodies. Accordingly, shipping, handling during manufacturing, loudspeaker assembly, etc. may be advantageously modified taking into account the improved robustness of the plastic cone body. Bonding, including thermoplastic elastomer (TPE) over-molding, to the plastic cone body of other loudspeaker elements such as surrounds and voice coils may be advantageously modified by secondary treatments such as Plasma treat in view of the added robustness of the plastic cone body.

In another example, the plastic cone body 206 may be formed with a process that introduces a filler that is a gas(es) that is distributed substantially uniformly throughout the plastic. The result may be a cone body with reduced weight and reduced warping without significant loss of stiffness. Accordingly, such a cone body may also have an improved stiffness to weight ratio. Example processes that may be used to introduce a filler that is a gas(es) into the plastic material include MUCELL, EXPANCEL or any other material and/or process capable of distributing a gas within the plastic.

In still another example, the plastic cone body 206 may include additional ultra light weight fillers. Example ultra light weight fillers include fly ash or cenosphere. The ultra light weight fillers may be included to further improve the stiffness to weight performance of the plastic cone body 206. (FIG. 2)

Cone bodies formed with such fillers exhibit a specific modulus that is significantly higher than with a cone body made of unfilled polypropylene (UF PP), as previously discussed. As also previously discussed, the percentages of plastic and nanomaterial used to form a cone body may be varied while still maintaining advantageously low specific gravity of the part. For example, a cone body may be formed with about 4 wt. % nanomaterial, about 6 wt. % polypropylene carrier resin and about 90 wt. % polypropylene. In another example, a cone body may be formed with about 12 wt. % nanomaterial, about 18 wt. % polypropylene carrier resin and about 70 wt. % polypropylene. In still another example, a cone body may be formed with about 20 wt. % nanomaterial, about 30 wt. % polypropylene carrier resin and about 50 wt. % polypropylene. In these examples, the average wall thickness of the cone bodies may be about 0.28 mm. In another example, a cone body may be formed with about 12 wt. % nanomaterial, about 18 wt. % polypropylene carrier resin and about 70 wt. % polypropylene, with an average wall thickness of about 0.19 mm. As previously discussed, the polypropylene carrier resin may be omitted or other types of plastic, such as liquid crystal polymer (LCP) and GTX, a proprietary General Electric alloy composed of nylon+PPO+polystyrene may be used in other examples.

In still other examples, the cone body may be molded with a MuCell process to include about 8 wt. % nanomaterial, such as a nanoclay, about 12 wt. % polypropylene carrier resin, about 1 wt. % Mucell super critical fluid (SCF) and about 80 wt. % polypropylene. In this example, the average wall thickness of the cone body may be about 0.28 mm. In yet another example, the cone body may be formed with about 8 wt. % nanomaterial, such as nanoclay, , about 12 wt. % polypropylene carrier resin, about 1 wt. % to about 3 wt. % Expancell and about 77 wt. % to about 79 wt. % polypropylene. In this example, the average wall thickness of the cone body may be about 0.28 mm. Adjusting the weight percent of the nanomaterial present in the base material directly affects the stiffness to weight ratio. As additional nanomaterial is added, stiffness increases, however, as previously discussed, the weight of the part stays substantially the same.

The acoustic damping is similarly change by adjustment of the weight percent of nanomaterial in the base material of a cone body, as previously discussed. Thus, as the wall section of a cone body is adjusted, the weight percent of nanomaterial may also be adjusted to maintain substantially the same stiffness of the cone body. However, adjustment of the weight percent of nanomaterial will adjust the damping. For example, if a determined thickness of a wall section of a cone body is reduced, the weight percentage of the nanomaterial may be increased to maintain substantially the same stiffness of the cone body even though the wall section is thinner. Since the weight percentage of the nanomaterial is increased, the damping of the cone body will decrease.

Figure 9:
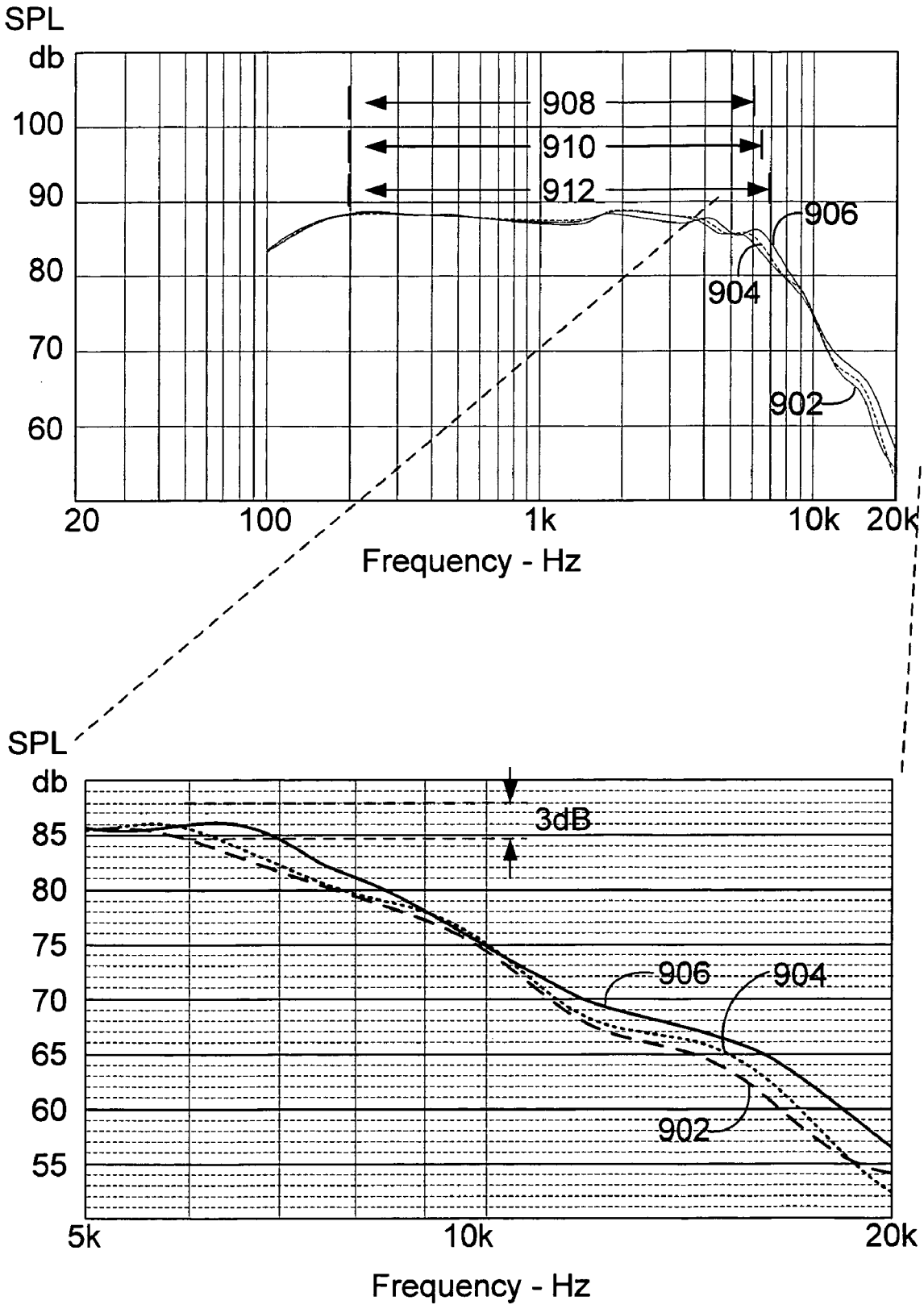
FIG. 9 is a set of frequency response curves depicting a loudspeaker having a polypropylene cone body and loudspeakers having a plastic cone body that includes a determined weight percentage of nanomaterials.

FIG. 9 is a set of example frequency response curves of a loudspeaker having a cone body formed with different materials. FIG. 9 also includes a close up view of a portion of the set of frequency response curves in the range of 5 kHz to 20 kHz. In this example, the weight of each of the cone bodies is substantially the same as evidenced by the sound pressure level (SPL) remaining substantially similar among the different frequency response curves in a pass band region. A first frequency response curve 902 is representative of the performance of a loudspeaker that includes a cone body molded with only high flow 34 melt nucleated co-polymer polypropylene, such as ACCPRO. A second frequency response curve 904 is representative of the performance of a loudspeaker that includes a cone body molded with carrier that is high flow 34 melt nucleated co-polymer polypropylene, such as ACCPRO, with nanomaterials of a first weight percent that is 8 weight percent. A third frequency response curve 906 is representative of the performance of a loudspeaker that includes a cone body molded with a carrier that is high flow 34 melt nucleated co-polymer polypropylene, such as ACCPRO with nano-materials of a second weight percent that is 16 weight percent. The example first, second and third frequency response curves 902, 904 and 906 are based on a 2.0 volt stepped sine wave input audio signal and measurement of the frequency response output of a corresponding loudspeaker at 1 meter. In addition, the nanomaterials and the carriers represented with frequency response curves 4902 and 4904 in this example were pellet blended.

In this example, the first frequency response curve 902 included a first pass band frequency range 908 from about 200 Hz to about 6 kHz that was substantially flat (within 3 decibels (dB) of variation). In addition, the magnitude of the sound pressure level (SPL) was about 88 dB. With regard to frequency, the term "about" describes a range of +/−500 Hz. With regard to SPL, the term "about" describes a range of about +/−0.2 dB.

In contrast, the second frequency response curve 904 at about the same SPL, has a SPL variation of about 3 dB (substantially flat) over a second pass band frequency range 910 from about 200 Hz to about 6.3 kHz, about 6.5 kHz, or about 7 kHz., or between about 6 kHz and 7 kHz. Thus, the second frequency response curve 904 has a frequency response with relatively lower variation in the SPL over a broader bandwidth than the first frequency response curve 902. More specifically, the variation of the SPL of the second pass band frequency range 910 remains less than about 3 dB from about 200 Hz to about 6.3 kHz, which includes an additional 300 Hz of higher frequency bandwidth than the first pass band frequency range 908. In addition, the variation in SPL of the second frequency response curve 904 is substantially flat and relatively lower over the broader bandwidth. The broader bandwidth and lower variation in SPL in the second frequency response curve 904 are due to the inclusion of the nanomaterials in the loudspeaker cone. Accordingly, the use of the 8 weight percent nanomaterials improves the range of desired frequency response that remains substantially flat (the pass band frequency range). In other examples, other carriers, other weight percentages of nanomaterial, other extrusion processes, other blending processes and other cone designs are possible.

In further contrast; the third frequency response curve 906, with a similar SPL has a variation in SPL of about 3 dB (substantially flat) over a third pass band frequency range 912 from about 200 Hz to about 7 kHz, or about 8 kHz, or between 7 kHz and 8 kHz. The loudspeaker cone that generated the third frequency response curve 906 includes a cone body with an additional 16 weight percent of nanomaterials with respect to the second frequency response curve 904. Thus, stiffness is improved with little or no added mass. Similar to the second frequency response curve 904, the third frequency response curve 906 is substantially flat throughout the third pass band frequency range 912. The pass band frequency range 912 of the third frequency response curve 906, however, has been extended to include additional high frequency bandwidth. In other words, in comparison with the first frequency response curve 902 that includes no nanomaterials, the third pass band frequency range 912 has an increased pass band frequency range, in this example by about 1 kHz, without a significant change in the variation in SPL or the mass of the plastic cone body.

In FIG. 9, when the variation of the SPL of the second frequency response curve 904 varies by more than about 3 db at the high frequency end of the second pass band frequency range 910, the first frequency response curve 902 is above the first pass band frequency range 908 by about 500 Hz. At the high frequency end of the second pass band frequency range 910, the variation in SPL of the first frequency response curve 902 is about 6 dB, resulting in a difference in variation in SPL between the first and second frequency response curves 902 and 904 of about 3 dB. At the high frequency end of the third pass band frequency response range 912, the first frequency response curve 902 is above the first pass band frequency range 908 by about 1 kHz. In addition, the variation in SPL of the first frequency response curve 902 is about 8 dB, when the variation in SPL of the third frequency response curve 906 is about 3 dB. Thus, significantly lower variation in SPL over a wider pass band frequency range may be achieved by including a determined percentage weight of nanomaterials in the plastic cone body. Accordingly, the performance of a loudspeaker having a cone body that includes nano-materials of a predetermined weight percent provide improve acoustic performance over a larger bandwidth than a loudspeaker having a cone body of pure polypropylene.

Comparing the second and third frequency response curves 904 and 906, the pass band frequency response range is made longer based on a change in the weight percentage of the nano-materials included in the plastic cone body. In FIG. 9, the third pass band frequency response range 912 is about 700 Hz longer than the second pass band frequency response range 910. Accordingly, a family of pass band frequency response ranges, about 500 Hz to about 1 kHz different can be created based on a corresponding range of weight percentages of nano-materials. Thus, due to the repeatability of manufacturing plastic cones, a predetermined weight percentage of nano-materials may be used to obtain a desired pass band frequency response.

The high frequency bandwidth is extended due to an improvement in the stiffness to weight ratio, where stiffness is increased by the addition of the nanomaterials. The variation in SPL may be reduced due to an extension of the frequency at which the cone enters a breakup mode. A breakup mode, is when the loudspeaker cone no longer behaves as a rigid piston. Choice of nano-materials weight percentage can be used to adjust the high frequency bandwidth to obtain a desired pass band frequency response range. For example, in some applications a reduced high frequency bandwidth (a shorter pass band frequency response range) of a midrange loudspeaker (having a cone body with a first predetermined weight percent of nano-materials enables improved system performance when coupling with a specific tweeter having a pass band frequency response range that extends to a relatively low frequency. If on the other hand, a specific tweeter has a pass band frequency response range that occupies only relative high frequencies, a mid range loudspeaker with a longer pass band frequency response (a cone body with a second predetermined weight percent of nanomaterials that is greater than the first predetermined weight percent) that extends to include more of the higher frequency bandwidth is desirable.

Figure 10:
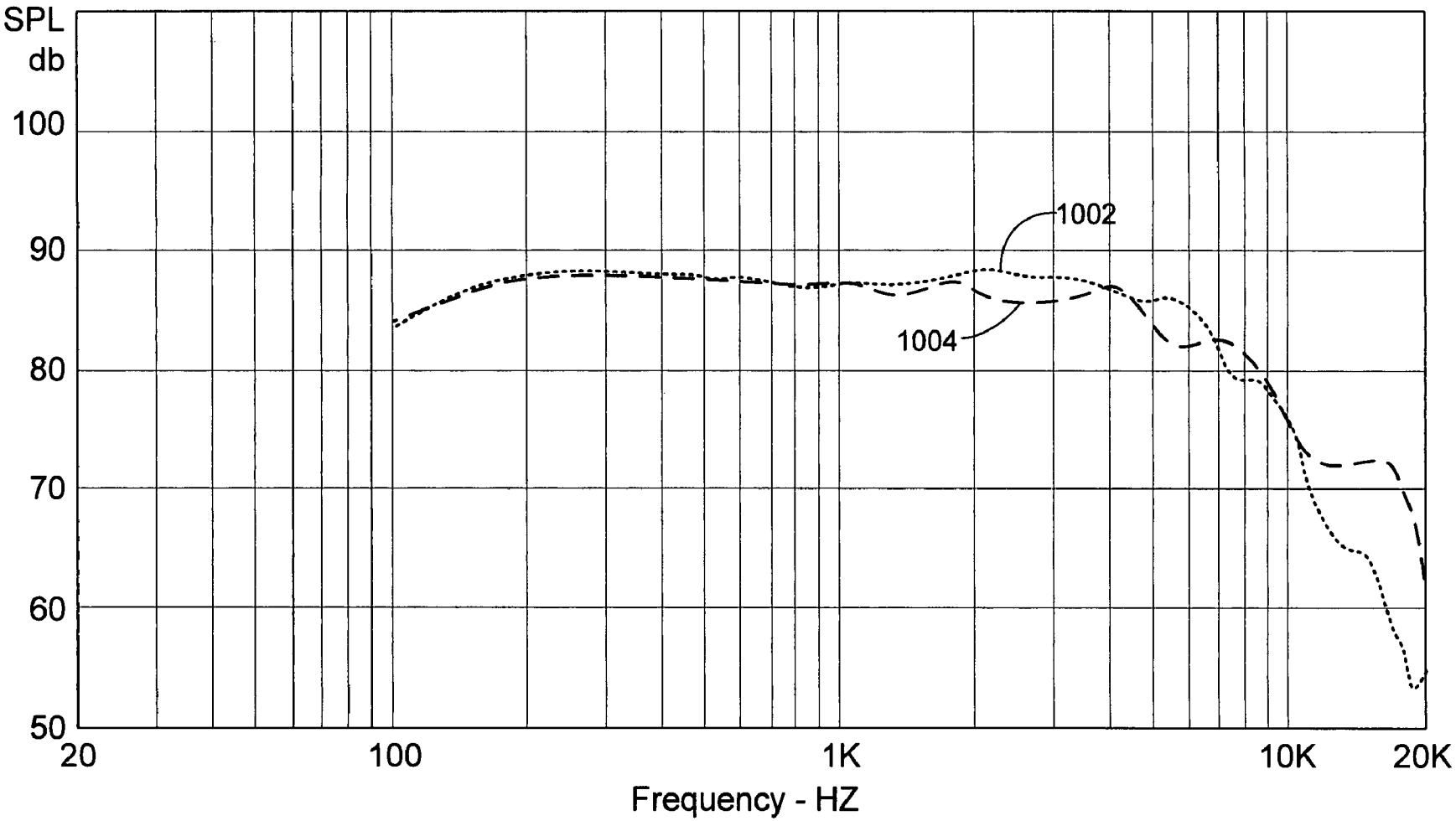
FIG. 10 is a frequency response curve of a loudspeaker having a kevlar cone body and a loudspeaker having a plastic cone body that includes a weight percentage of nanomaterials.

FIG. 10 is an example of a first frequency response curve 1002 of a loudspeaker having a cone body molded with unfilled high flow homopolymer polypropylene with nanomaterials and a second frequency response curve 1004 of a loudspeaker having a cone body formed with a Kevlar composite. Kevlar composite cone bodies are known to be relatively high performance cone bodies that may be used in loudspeakers. As depicted in FIG. 10, the variation in SPL of the first frequency response curve 1002 was significantly improved with respect to the SPL of the second response curve 1004 between about 2 kHz and about 7 kHz. More specifically, the variation in SPL of the first frequency response curve 1002 was about 2 dB between about 150 Hz and about 6 kHz. In contrast, the variation in SPL of the second frequency response curve 1004 was about 5 dB between about 150 Hz and about 6 kHz. Thus, the performance of a loudspeaker that includes a cone body having an unfilled high flow polypropylene with nanomaterials is significantly better than the acoustic performance of a loudspeaker that includes a Kevlar cone body.

Due to the improved stiffness to weight ratio, sensitivity may also improve. In the previous examples illustrated in FIGS. 9 and 10, the sensitivity was improved by as much as 1 or 2 dB. In addition, as previously discussed, the useable bandwidth of a loudspeaker made with a cone body having an unfilled high flow polypropylene with nano-materials may be increased due to the increased stiffness and reduced weight. The energy storage and dissipation properties may also significantly improve damping in a loudspeaker that includes a cone body having unfilled high flow polypropylene with nanomaterials as evidenced by the minimized variation in SPL.

Figure 11:
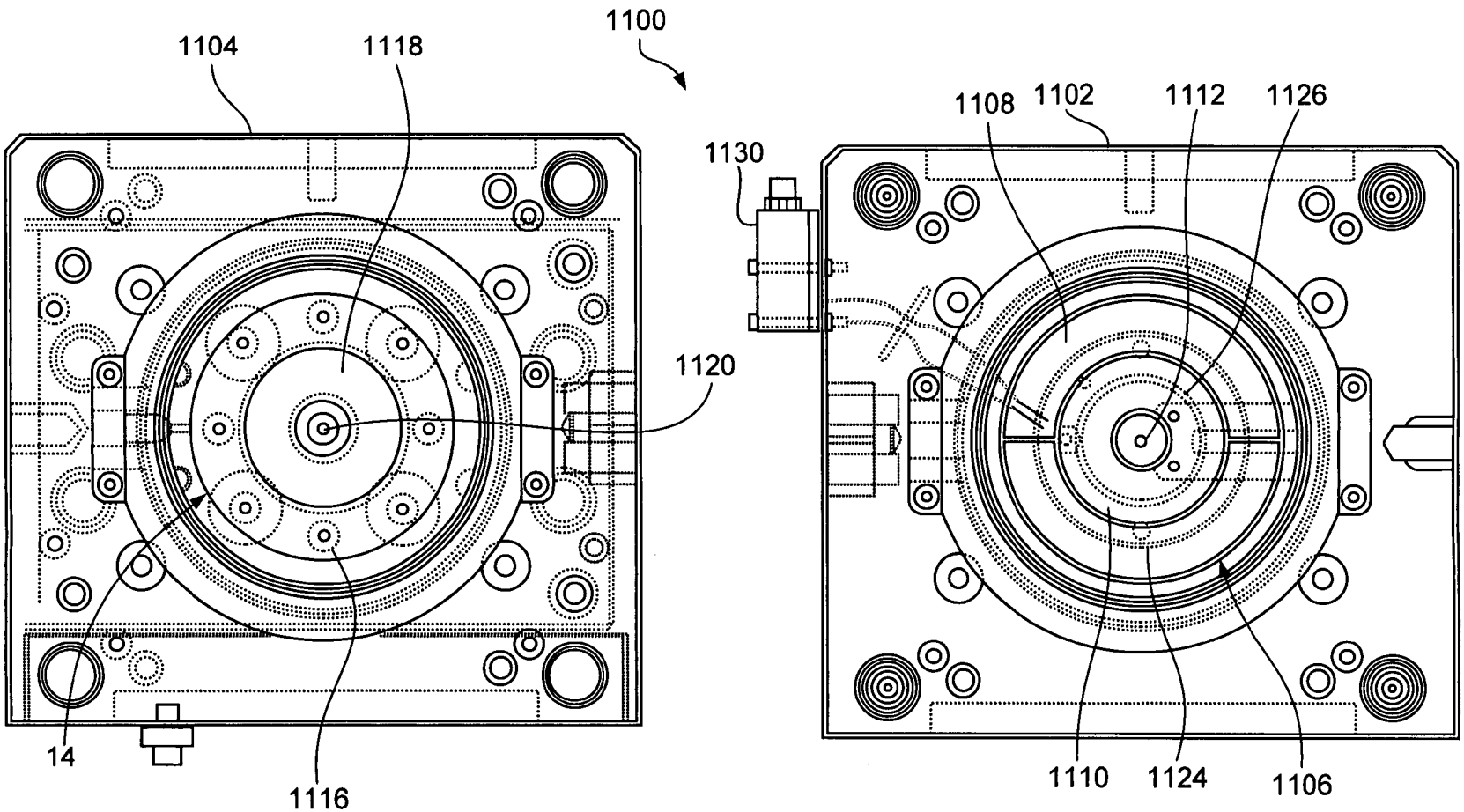
FIG. 11 is an example tool used for molding plastic cone bodies that include nanomaterials.

An example tool used in the thin wall molding process is illustrated in FIG. 11. The tool 1100 includes a first half 1102 and a second half 1104. The tool 1100 may be made of any rigid material, such as steel, capable of withstanding the temperatures and pressures associated with molding. The first half 1102 may be described as the fixed part of the mold 1100 and the second half 1104 may be described as the moving part of the mold to reflect operational aspects of the mold 1100. The first half 1102 may include a first mold insert 1106 that is formed with a circumferentially surrounding first shoulder area 1108, a protruding conically shaped area 1110 and a gate 1112 that is operable as a material inlet port. The second half 1104 may include second mold insert 1114, a circumferentially surrounding second shoulder area 1116, a recessed conically shaped 1118 and a diaphragm 1120.

The first and second inserts 1106 and 1114 may be removable from the respective first and second halves 1102 and 1104 of the mold 1100. The first and second inserts 1106 and 1114 may be formed with any rigid material capable of operation at elevated temperature and pressure. In one example, the first and second inserts 1106 and 1114 may be beryllium copper to improve heat transfer. The first and second inserts 1106 and 1114 may be operated at a predetermined temperature, such as in a range of about 82 to about 107 degrees Celsius to increase crystalline structure and decrease amorphous structure in the material during forming of the cone body.

The first and second shoulders 1108 and 1116 may form a seal between the first and second inserts 1106 and 1114. The first and second shoulders 1108 and 1116 may include venting to allow air to escape when nanocomposite material is injected into the mold. The protruding conical area 1110 may be formed to fit within the recessed conical area 1118 when the first and second halves 1102 and 1104 are brought together. The protruding conical area 1110 may also include a first roughened circular surface 1124 disposed adjacent an outer edge of the protruding conical area 1110 and a second roughened circular surface 1126 disposed on the protruding conical area 1110 to be surrounded by the first roughened circular surface 1124. The first and second roughened surfaces 1124 and 1126 may form an uneven surface, such as a sandblasted effect, on a cone body formed in the mold 1100. The uneven surface may advantageously create additional friction when a surround is bonded near an outer periphery edge of the cone body and a coil former is bonded near an inner periphery edge of the cone body. In addition, the uneven surfaces may allow a cone body to be more easily released from the mold 1100. The second roughened surface 1126 may be formed to surround the gate 1112.

The gate 1112 allows the injection of material, such as a combination of plastic and nanomaterials into the area between the first and second inserts 1106 and 1114. The gate 1112, may be in the shape of a diaphragm. The diaphragm may enter the part at and around the full circumference of the inside aperture of the cone body. This geometry favors fast uniform fully circumferential fill of plastic from the gate 1112 to the edge of the cone body. Core and cavity locks may be employed in the tool construction as well, to prevent lateral movement of the core and cavity during high pressure injection. Lateral movement may lead to non-uniform (thick/thin spots) wall structure, and lateral material flow during the filling process. The lateral material flow may produce undesirable weld line defects. The material may be injected through the gate 1112 at a relatively high melt pressure, for example, up to 248.2 MPa. The relatively high pressure allows a relatively fast fill time, for example, less than or equal to about 0.5 seconds, or less than or equal to about 1 second, or in a range between about 0.5 seconds and about 1 second, as opposed to a standard fill time that may be about 2 seconds or longer. The fast flow time advantageously avoids premature hardening of the material and undesirable backflow. Thus, the nanocomposite material is uniformly dispersed throughout the mold.

A mold sensor 1130 may also be included on the first half 1102 of the mold 1100. The mold sensor 1130 may be an operational parameter measurement device capable of providing indication of one or more operational parameters associated with the molding process. In one example, the mold sensor 1130 may be a pressure transducer that senses the pressure in the cavity between the first and second inserts 1106 and 1114. Operational parameter(s) associated molding process may be used to achieve better consistency and control during forming of a cone body.

The diaphragm 1120 may be used to control the feed rate of the nanocomposite material into the mold 1100 through the gate 1112. In addition, the diaphragm may provide a uniform feed of nanocomposite material into the mold 1100, such as the illustrated circular geometry.

Figure 12:
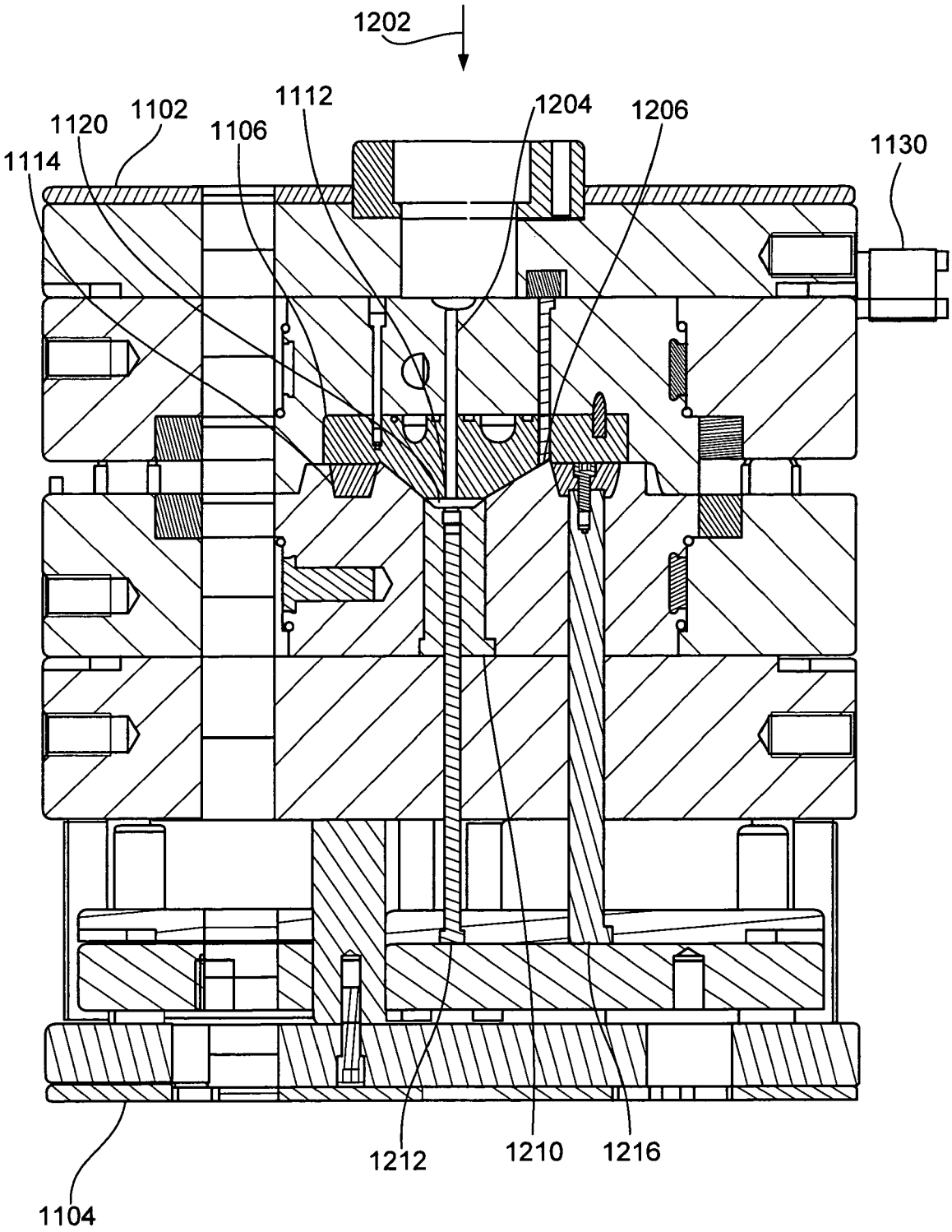
FIG. 12 is a cross-sectional side view of the tool illustrated in FIG. 11.

FIG. 12 is a cross-sectional view of the example tool illustrated in FIG. 11 that includes the first half 1102 and the second half 1104. Material such as a combination of plastic and nanomaterials may enter the mold 1100 as illustrated by arrow 1202. The nanocomposite material may flow through a conduit 1204 and the gate 1112. In some examples, the conduit 1204 may be unheated, resulting in a sprue being present on the molded part. In other examples, the conduit may be a heated bushing or a valve gate to keep the nanocomposite material in the conduit 1204 hot to avoid forming a sprue on the molded part. This condition improves material utilization and reduces process costs.

The nanocomposite material may be uniformly fed by the diaphragm 1120 into a cavity 1206 formed between the first and second inserts 1106 and 1114. The diaphragm 1120 may form a circular aperture through which the nanocomposite material flows. The size of the circular aperture may be adjusted with a gate adjustment 1210. In one example, a number of gate adjustments 1210 of varying thicknesses from about 0.2 mm to about 0.3 mm may be interchangeably inserted in the tool 1100 to select the size of the circular aperture formed with the diaphragm 1120.

The second half 1104 of the tool 1100 may also include a sucker pin 1212 that is defined with an undercut. During operation, the sucker pin 1212 becomes encased in the nanocomposite material that remains below the diaphragm 1120. Once encased, the sucker pin 1212 may be used to draw a vacuum and hold the formed cone body to the second half 1104 when the second half 1104 is moved away from the first half 1102 to separate the first and second halves 1102 and 1104.

Core locks 1216 may be used to maintain uniformity and parallelism in the distance between the first and second inserts 1106 and 1114 across the mold 1100. In addition, the gate adjustment 1210 may be used to adjust the geometry of the gate 1112 and the thickness of the cone body. The gate adjustment 1210 and the core locks 1216 may cooperatively operate to maintain uniformity in the formed cone body. Accordingly, side flows that create weak points ("weld" lines) in the formed cone body may be avoided. In one example, the standard wall thickness may be adjusted in a range from about 0.25 mm to about 0.33 mm. In another example, the wall thickness may be in a range from about 0.15 mm to about 0.23 mm.

In experimental mold trials performed with the tool, a first mold configuration provided cone bodies with a tapered wall section thickness in a range of about 0.25 mm at the cone neck to about 0.33 mm at the cone outer diameter. A second mold configuration provided cone bodies with a wall section thickness in a range of about 0.25 mm at the cone neck to about 0.13 mm at the cone diameter. Mold configurations such as the first mold configuration may be used with nanomaterials having a relatively lower flex modulus and relatively high specific gravity when compared to mold configurations, such as the second mold configuration, that provide a relatively thinner nominal wall thickness of the cone bodies. Thus, the mold configurations may be used to control the body weight of the cone bodies. Nanocomposites used with the second mold configuration may have a relatively high flex modulus and a relatively low specific gravity when compared with nanomaterials used with the first mold configuration. The first and second mold configurations are for experimental purposes, and other mold designs and/or cone body wall thicknesses are contemplated, such as, cone body wall section thicknesses in a range of about 0.1 mm to about 0.5 mm.

Although the previous discussion is focused on cone bodies for loudspeakers, the described materials and processes may also be applied to produce dustcaps, wizzers, spiders and/or surrounds for loudspeakers. Accordingly, a cone body and a surround may be co-molded as a single unit with the same or different materials. Alternatively, a cone body may be separately molded, and a surround over-molded with the same or a different material. The surround may be over molded to be bonded to the outer roughened surface of a formed cone body. In another alternative, a surround may be molded separately and bonded to the outer roughened surface of a cone body. The previously described benefits with regard to material costs, repeatability, manufacturing efficiency and desirable characteristics may also be present in surrounds and spiders.

In one example of an overmolded surround, a surround may be formed from a material that is compatible with polypropylene and made with a material such as thermoplastic vulcanizate (TPV). In this example, the material may be between approximately 45 Shore A and 75 Shore A. The TPV may be injection molded onto a nanocomposite polypropylene based cone body of a predetermined weight percent, such as, an 8 wt. % or 12 wt. % net conebody. The cone may be placed on a locating post in an injection mold. In one example a tool construction may be used that employs four (4) valve gates for material and process productivity. The valve gates may be directed into the flat "collar" of the surround. A gate break may be maintained flush with, or just below, the bonding surface of the collar to support secondary assembly. The mold design may permit selective heating at the cone edge as a means to improve or create optimized overmolding adhesion. The surround may be designed to be overmolded onto a cone body in any configuration that provides sufficient material flow to result in a robust, void free, and uniform direct bond between the surround and the cone body. In one example, the surround may be configured according to the teachings of U.S. Pat. No. 6,224,801 to Mango, et.al., which is herein incorporated by reference, to promote substantial material flow around the part prior to filling the surround roll.

As a result of the overmolding, the surround that is created should be a void free roll structure that is direct bonded to the cone body. Accordingly, adhesives, costly assembly operations and related quality issues may be avoided. As compared to surrounds made from thermoformed sheet stock or molded thermoset rubber, material and process efficiency may be significantly improved. In other examples, the surround material may be formed with a block copolymer, such as SBS, SIS, SES, SEPS, SEBS and the like. In still another example the surround may be a thermoplastic olefin, (TPO). In yet another example, the surround may be any flexible elastomer containing heteroatoms in addition to carbon and hydrogen, such as thermoplastic urethanes (TPU's) or thermoplastic polyester elastomers (TPE's) and the like. The various plastic materials may be filled with conventional or nanosize fillers or contain gas cells to advantageously alter properties and weight. The various materials also may be advantageously modified to promote adhesion to various cone body materials, or subjected to secondary treatments such as hot air plasma to promote adhesion to a speaker frame.

The dustcaps and whizzers may be formed to fit over the voice coil or may be inserted inside the voice coil. Since the dustcap and whizzers are part of the moving mass, the mass weight of the whizzers and dustcaps may be advantageously reduced with the use of nanocomposites. In addition, the stiffness of the dustcaps and whizzers may be advantageously improved. Stiffer dustcaps and whizzers may minimize harmonics during operation of a loudspeaker. Accordingly, drop-outs of certain frequency bands may be avoided.

Figure 13:
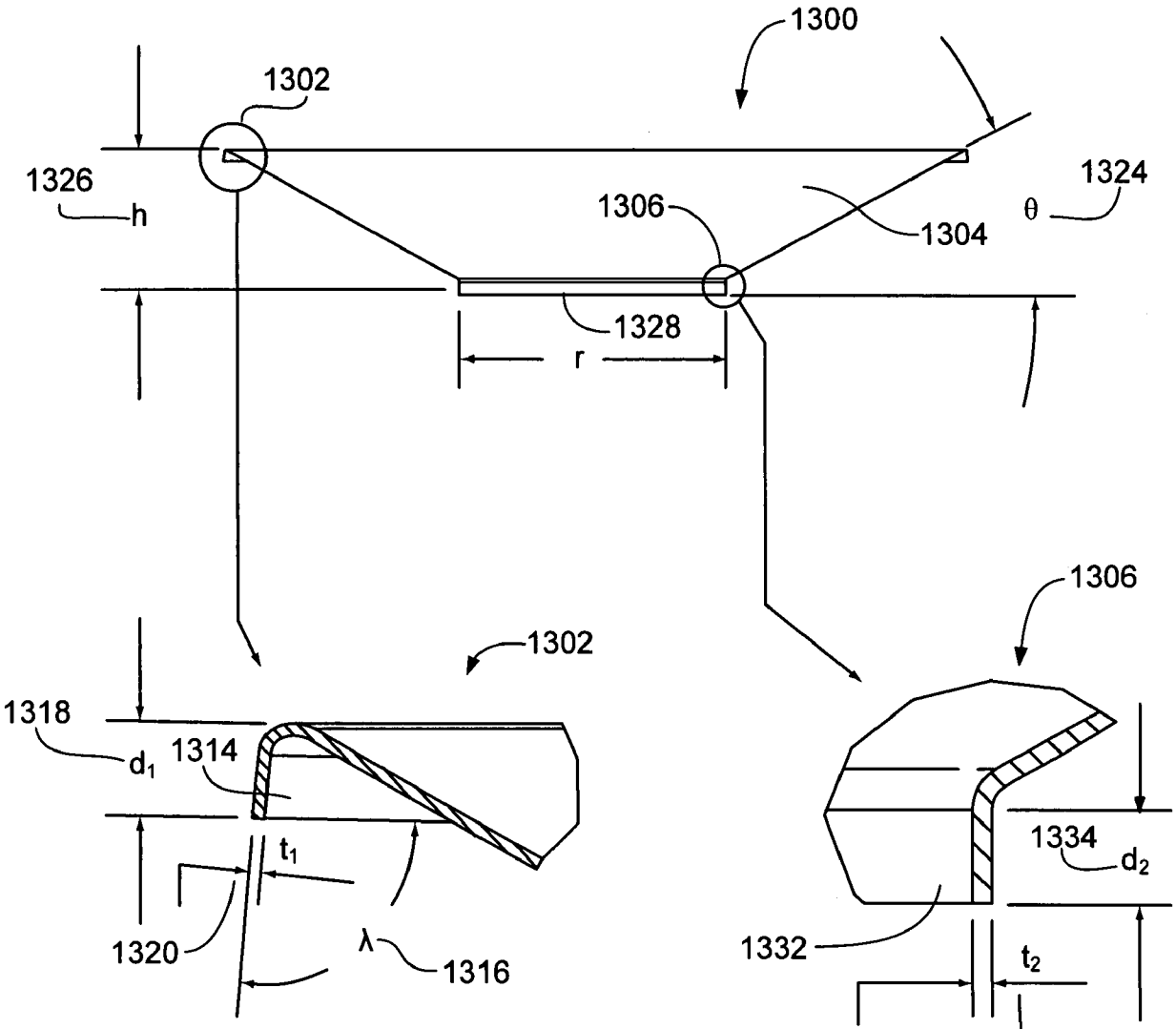
FIG. 13 is a cross-sectional side view of an example cone body formed with the tool illustrated in FIG. 11.

FIG. 13 is a cross-sectional view of an example cone body 1300 formed with the tool 1100 (FIG. 11). The cone body 1300 of this example is circular and includes an outer lip 1302, a sidewall 1304 and an inner lip 1306. The outer lip 1302 may circumferentially surround a portion of the cone body, and may be formed to stiffen the cone perimeter. In one example, the outer lip 1302 may be coupled with a loudspeaker frame via a surround. In an alternative example, the outer lip 1302 may be direct coupled with the loudspeaker frame. The outer lip 1302 may define the outer periphery of the cone body 1300. The outer lip 1302 may include an outer wall 1314 that forms a predetermined angle ($\lambda$) 1316 with respect to the sidewall 1304, such as greater than 90 degrees, or about 95 degrees. The outer wall 1314 may extend longitudinally a predetermined distance ($d_1$) 1318 away from the sidewall 1304. The outer wall 1314 may also be a predetermined thickness ($t_1$) 1320. The cone may also be formed without an outer lip 1302.

The sidewall 1304 may form a conical shape that extends between the outer lip 1302 and the inner lip 1306. The slope of the sidewall 1304 may be define by an angle ($\theta$) 1324, such as about 28.8 degrees, the distance between the outer lip 1302 and the inner lip 1306 and/or a height (h) 1326. The inner lip 1306 may define an aperture 1328 that is concentrically positioned in the cone body 1100. The aperture 1328 may have a predetermined radius (r) and be formed to receive a voice coil former 116 (FIG. 1). The inner lip 1306 may include an outer wall 1332 that forms a predetermined angle with respect to the sidewall 1304. The predetermined angle may be the angle ($\theta$) 1324 plus 90 degrees. The outer wall 1332 may extend longitudinally a predetermined distance (d2) 1334, such as about 1.2 millimeters away from the sidewall 1304. The outer wall 1332 may also be a predetermined thickness (t2) 1336.

The sidewall 1304 of the cone bodies may be formed with a uniform thickness. Alternatively, the sidewall 1304 may be tapered. Tapering may be accomplished by tapering the projecting conical area 1110 and the recessed conical area 1118 (FIG. 11). In one example, the first and second inserts 1106 and 1114 may be formed to operatively cooperate to form a sidewall that becomes progressively thinner from the material inlet port 1112 (FIG. 11) toward the first and second shoulder area 1108 and 1116 (FIG. 11). In addition, to saving material, controlling sidewall thickness may provide another mechanism to modify the loudspeaker bandwidth by changing the stiffness, in this case by modifying geometry rather than material.

Figure 14:
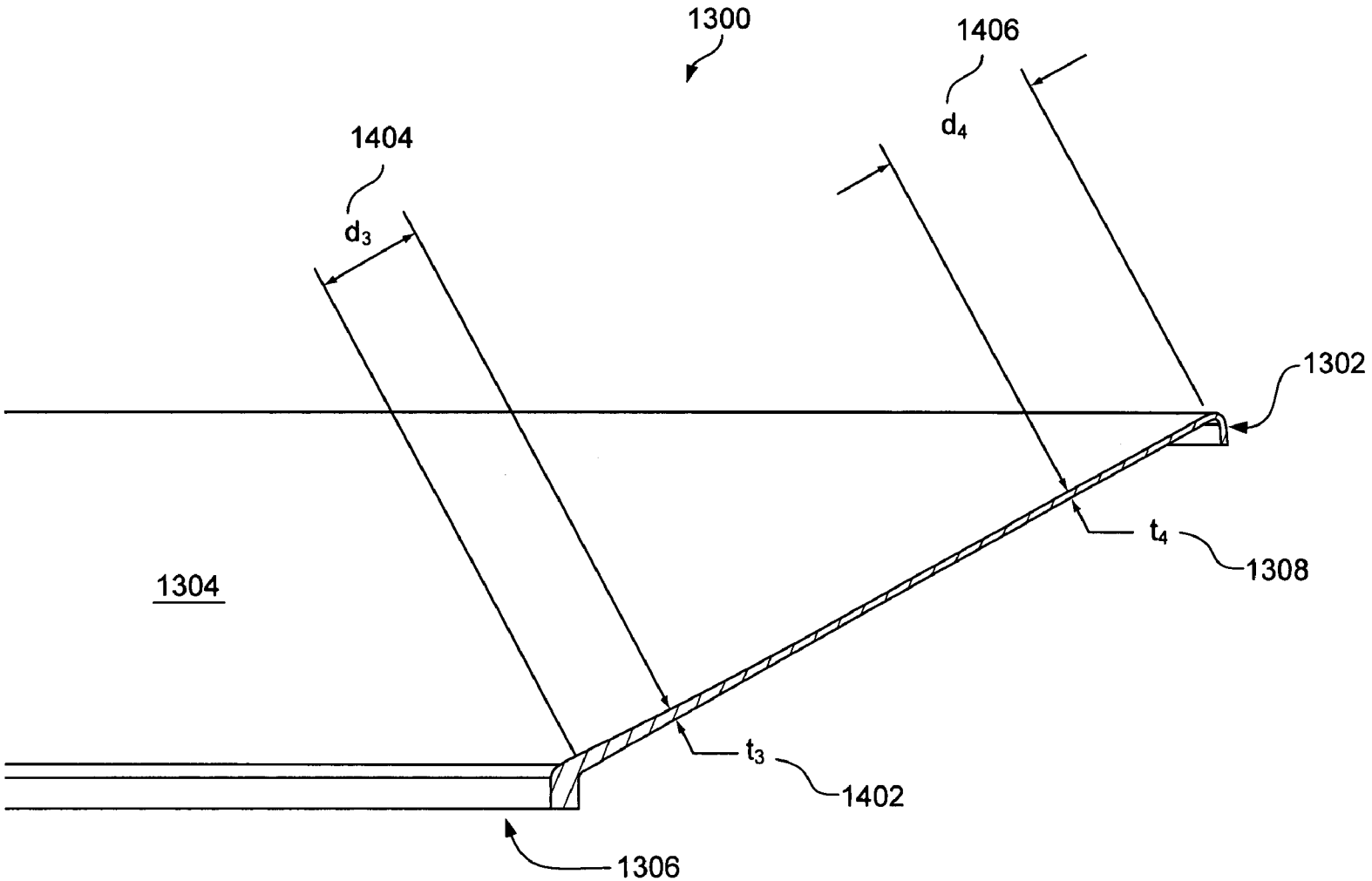
FIG. 14 is a partial cross-sectional side view of the cone body illustrated in FIG. 13.

In FIG. 13, the thickness (t2) 1336 of the outer wall 1332 of the inner lip 1306 may be greater than the thickness of the sidewall 1304, and the thickness (t1) 1320 of the outer lip 1314 may be less than the thickness of sidewall 1304. FIG. 14 is a partial cross sectional view of the cone body illustrated in FIG. 13. The sidewall 1304 depicted in FIG. 14 illustrates that the thickness of the side wall 1304 becomes progressively smaller from the inner lip 1306 toward the outer lip 1302. In one example, a thickness (t3) 1402 of the sidewall 1304 at a distance d3 1404 of about 4.0 millimeters from the inner lip 1306 is in a range of about 0.22 millimeters to about 0.32 millimeters, and at a distance d4 1406 of about 6.0 millimeters from the outer lip 1302, a thickness (t4) 1408 of the sidewall 1304 is in a range of about 0.17 millimeters to about 0.27 millimeters. Additionally, in this example, the thickness (t2) 1336 of outer wall 1332 of the inner lip 1306 may be in a range of about 0.23 millimeters to about 0.33 millimeters, and the thickness (t1) 1320 of the outer wall 1314 of the outer lip 1302 may be about 0.15 millimeters to about 0.25 millimeters. In other examples, other ranges of thickness are possible.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We Claim:

1. A loudspeaker cone comprising:

a thermoplastic base material; and a filler distributed in the thermoplastic base material, where the filler comprises a phyllosilicate nanostructure material distributed in the thermoplastic base material, the phyllosilicate nanostructure material having a sheet structure that is less than about $10^{-9}$ meters in at least one dimension to enhance a stiffness characteristic of the thermoplastic base material;

the thermoplastic base material and the phyllosilicate nanostructure material forming a high flow composition having a weight percentage of phyllosilicate nanostructure material between about 4 weight percent and about 20weight percent and a viscosity shear rate ratio of 3 or greater for use in injection molding of thin walled loudspeaker cones, where the predetermined weight percentage is adjustable between about 4weight percent and about 20 weight percent to adjust a high frequency end of a pass band frequency response range in a loudspeaker in which the loudspeaker cones is to be installed and operated while maintaining the viscosity shear rate ratio of 3 or greater.

2. A loudspeaker cone comprising:

a thermoplastic base material; and a predetermined weight percentage of a phyllosilicate nanostructure material distributed in the thermoplastic base material to form a composition material having a viscosity to shear rate ratio of greater than 3, wherein the phyllosilicate nanostructure material comprises features distributed in the thermoplastic base material that are less than about $10^{-9}$ meters in at least one dimension to enhance a stiffness characteristic of the thermoplastic base material;

where the predetermined weight percentage is adjustable to adjust a high frequency end of a pass band frequency response range in a loudspeaker in which the loudspeaker cones is to be installed and operated while maintaining the viscosity shear rate ratio of greater than 3.

3. A loudspeaker cone comprising:

a thermoplastic base material; and a predetermined weight percentage of a nanoclay that is distributed in the thermoplastic base material to establish a melt flow rate during injection molding that is greater than or equal to about 12 grams/10 minutes at about 230degrees Celsius and about 2.16 kilograms of load, wherein the nanoclay comprises features distributed in the thermoplastic base material that are less than about $10^{-9}$ meters in at least one dimension to enhance a stiffness characteristic of the thermoplastic base material;

where the melt flow rate remains greater than or equal to about 12 grams/10minutes at about 230 degrees Celsius and about 2.16 kilograms of load during injection molding as the predetermined weight percentage is adjusted between about 4 weight percent and about 20 weight percent to adjust a high frequency end of a pass band frequency response range in a loudspeaker in which the loudspeaker cones is to be installed and operated.

4. The loudspeaker cone of claim 1, where the features comprise a nanostructure formed in the thermoplastic base material.

5. The loudspeaker cone of claim 1, where the thermoplastic base material is a high flow polypropylene and a wall thickness of the loudspeaker cone is between about 0.1 millimeter and about 0.33 millimeters.

6. The loudspeaker cone of claim 1, where a stiffness of the loudspeaker cone is changeable based on adjustment to the predetermined weight percentage between about 1 weight percent and about 16 weight percent, and the weight of the loudspeaker cone changes by less than or equal to 10 percent.

7. A loudspeaker comprising:

a cone body comprising a wall section of a determined thickness, the cone body having a stiffness and a damping, where the wall section comprises a weight percentage of a thermoplastic base material and a weight percentage of phyllosilicate nanostructure material distributed in the thermoplastic base material to form a composition material having a viscosity to shear rate ratio of greater than 3, the phyllosilicate nanostructure material having a sheet structure; and a voice coil former coupled with the cone body, where the cone body is operable to vibrate when the voice coil former is reciprocated, where adjustment of the determined thickness and adjustment of the weight percentage of the phyllosilicate nanostructure material results in the stiffness remaining substantially the same, the viscosity to shear rate ratio remaining greater than 3 and the damping being changed.

8. The loudspeaker of claim 7, where the damping decreases as the weight percentage of the phyllosilicate nanostructure material is increased, and increases as the weight percentage of the phyllosilicate nanostructure material is decreased.

9. The loudspeaker of claim 7, where the thermoplastic base material is a high flow polypropylene that is combined with the phyllosilicate nanostructure material such that the viscosity to shear rate ratio enables injection of the composition material to fill a mold having a wall section with a determined thickness of between about 0.1 millimeters and about 0.33 millimeters.

10. A loudspeaker comprising:

a cone body comprising a wall section of a determined thickness, the cone body having a stiffness and a damping, where the wall section comprises a weight percentage of a thermoplastic base material and a weight percentage of a nanomaterial and where the determined thickness is tapered between an inner orifice formed by the loudspeaker cone and an outer peripheral edge of the loudspeaker cone; and a voice coil former coupled with the cone body, where the cone body is operable to vibrate when the voice coil former is reciprocated, where adjustment of the determined thickness and adjustment of the weight percentage of the nanomaterial results in the stiffness remaining substantially the same and the damping being changed.

11. The loudspeaker of claim 10, where the determined thickness of the loudspeaker cone is tapered between about 0.25 millimeters at the inner orifice and about 0.13 millimeters at the outer peripheral edge.

12. The loudspeaker of claim 10, where the determined thickness of the loudspeaker cone is tapered between about 0.25 millimeters at the inner orifice and about 0.33 millimeters at the outer peripheral edge.

13. The loudspeaker cone of claim 1, where the high flow composition is formed to establish a melt flow rate during injection molding that is greater than or equal to about 12 grams/10 minutes at about 230degrees Celsius and about 2.16 kilograms of load.

14. The loudspeaker cone of claim 2, where the composition material is formed to establish a melt flow rate during injection molding that is greater than or equal to about 12 grams/10 minutes at about 230degrees Celsius and about 2.16 kilograms of load.

15. The loudspeaker cone of claim 3, where the loudspeaker cone is formed by injection molding, and the thermoplastic base material with the nanoclay distributed therein has a viscosity to shear rate ratio capable of filling a mold having a wall section with a determined thickness of between about 0.1 millimeters and about 0.33 millimeters.

16. The loudspeaker of claim 7, where the composition material is formed to establish a melt flow rate during injection molding that is greater than or equal to about 12 grams/10 minutes at about 230 degrees Celsius and about 2.16 kilograms of load.

17. The loudspeaker of claim 10, where the nanomaterial comprises a phyllosilicate nanostructure material having a sheet structure.

18. The loudspeaker of claim 17, where the nanomaterial is distributed in the thermoplastic base material to form a composition material having a viscosity to shear rate ratio of greater than 3.

19. The loudspeaker of claim 17, where the thermoplastic base material and the nanomaterial form a high flow composition having a weight percentage of phyllosilicate nanostructure material between about 4 weight percent and about 20 weight percent and a viscosity shear rate ratio of 3 or greater.

20. The loudspeaker of claim 10, where the thermoplastic base material and the nanomaterial form a composition, and the weight percentage of the nanomaterial included in the composition establishes a melt flow rate during injection molding that is greater than or equal to about 12 grams/10 minutes at about 230 degrees Celsius and about 2.16 kilograms of load.

* * * * *

UNITED STATES PATENT AND TRADEMARK OFFICE

CERTIFICATE OF CORRECTION

PATENT NO. : 7,945,069 B2
APPLICATION NO. : 11/286872
DATED : May 17, 2011
INVENTOR(S) : Louis Mango, III, John F. Steere and Steven W. Hutt It is certified that error appears in the above-identified patent and that said Letters Patent is hereby corrected as shown below:

On The Title Page 2, Item (56)

Under Other Publications insert the following:

-- "Commercializing Nanocarbon in Japan Part I – Interview MEFS Co., Ltd., Prof. M. Endo's Start-up," Asia Pacific Nanotech Weekly, Vol. 3, Article #5 (Jan. 2005) © Nanotechnology Research Institute, AIST. --

Signed and Sealed this
Fifth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,945,069 B2
APPLICATION NO. : 11/286872
DATED : May 17, 2011
INVENTOR(S) : Louis A. Mango, III et al.

It is certified that error appears in the above-identified patent and that said Letters Patent is hereby corrected as shown below:

In the Claims

Column 22, Line 56, please insert --between about 4 weight percent and about 20 weight percent of-- after "of".

Column 23, Line 40, please insert --between about 4 weight percent and about 20 weight percent-- after "material".

Column 24, Line 6, please insert --between about 4 weight percent and about 20 weight percent-- after "nanomaterial".

Column 24, Line 55, please delete "a weight percentage of phyllosilicate nanostructure material between about 4 weight percent and about 20 weight percent and" after "having".

Signed and Sealed this
Eighteenth Day of October, 2011

David J. Kappos

David J. Kappos
*Director of the United States Patent and Trademark Office*